US007748192B2

(12) United States Patent
Ryder

(10) Patent No.: US 7,748,192 B2
(45) Date of Patent: Jul. 6, 2010

(54) BUILDING BLOCKS AND LOCATION DEVICES FOR REINFORCED CONCRETE WALLS

(75) Inventor: George Ralph Ryder, Queensland (AU)

(73) Assignee: Global Ryder Holdings Pty Ltd., Queensland (AU)

( * ) Notice: Subject to any disclaimer, the term of this patent is extended or adjusted under 35 U.S.C. 154(b) by 1082 days.

(21) Appl. No.: 10/502,558

(22) PCT Filed: Jan. 21, 2003

(86) PCT No.: PCT/AU03/00057

§ 371 (c)(1),
(2), (4) Date: Apr. 18, 2005

(87) PCT Pub. No.: WO03/062549

PCT Pub. Date: Jul. 31, 2003

(65) Prior Publication Data

US 2006/0272259 A1 Dec. 7, 2006

(30) Foreign Application Priority Data

Jan. 21, 2002 (AU) ..... PS0050

(51) Int. Cl.
*E04B 1/02* (2006.01)

(52) U.S. Cl. ..... 52/569; 52/563; 52/503; 52/571; 52/606

(58) Field of Classification Search ..... 52/436–437, 52/431, 585.1, 586.1, 742.14, 503, 568, 569, 52/590.1, 590.2, 742.12, 309.12, 606, 604–605, 52/563, 565, 571, 285.1, 592.4–592.6, 677, 52/687; 405/446

See application file for complete search history.

(56) References Cited

U.S. PATENT DOCUMENTS

| | | | | | |
|---|---|---|---|---|---|
| 1,373,266 | A | * | 3/1921 | Smith | 52/687 |
| 2,349,399 | A | * | 5/1944 | Awbrey | 52/686 |
| 3,170,267 | A | * | 2/1965 | Rosenfeld | 52/105 |
| 3,512,330 | A | * | 5/1970 | Shlesinger | 52/677 |
| 3,512,331 | A | * | 5/1970 | Palmer | 52/687 |
| 3,888,060 | A | * | 6/1975 | Haener | 52/284 |

(Continued)

FOREIGN PATENT DOCUMENTS

| | | |
|---|---|---|
| AU | 24868/95 | 1/1996 |

(Continued)

*Primary Examiner*—Brian E Glessner
*Assistant Examiner*—James J Buckle, Jr.
(74) *Attorney, Agent, or Firm*—Knobbe Martens Olson & Bear LLP

(57) ABSTRACT

A building block (2) comprising two side panels (6, 8) with at least one open side, the side panels spaced apart by two bridging parts (10, 12), a removable section (17) on at least one bridging part (10, 12), and a pair of recessed or protruding formations (20) on opposite inner faces of the open end of the side panels (6, 8) to enable building blocks to be interconnected. A location device (40) comprising two members (44) spaced apart by cross members (42), where the two members (44) extend beyond the cross members (42) to engage with formations (26) of one or more building blocks (2) is also disclosed. A wall constructed from building blocks (2) and utilising location devices (40) and a method of constructing such a wall are similarly disclosed.

40 Claims, 33 Drawing Sheets

U.S. PATENT DOCUMENTS

| | | | | | |
|---|---|---|---|---|---|
| 3,968,615 | A | * | 7/1976 | Ivany | 52/439 |
| 4,439,967 | A | * | 4/1984 | Dielenberg | 52/309.12 |
| 4,597,236 | A | * | 7/1986 | Braxton | 52/564 |
| 4,640,071 | A | | 2/1987 | Haener | |
| 4,698,947 | A | * | 10/1987 | McKay | 52/309.12 |
| 4,866,891 | A | * | 9/1989 | Young | 52/105 |
| 4,884,382 | A | * | 12/1989 | Horobin | 52/426 |
| 5,072,556 | A | * | 12/1991 | Egenhoefer | 52/126.4 |
| 5,159,795 | A | | 11/1992 | Colen | |
| 5,231,815 | A | | 8/1993 | Colen | |
| 5,351,457 | A | | 10/1994 | Colen | |
| 5,566,518 | A | | 10/1996 | Martin et al. | |
| 5,729,949 | A | * | 3/1998 | Hartzheim | 52/677 |
| 5,829,217 | A | * | 11/1998 | Colen | 52/442 |
| 5,901,520 | A | * | 5/1999 | Abdul-Baki | 52/592.6 |
| 6,065,265 | A | * | 5/2000 | Stenekes | 52/607 |
| 6,134,853 | A | * | 10/2000 | Haener | 52/405.2 |
| 6,230,462 | B1 | * | 5/2001 | Beliveau | 52/426 |
| 6,308,484 | B1 | * | 10/2001 | Severino | 52/426 |
| 6,318,040 | B1 | * | 11/2001 | Moore, Jr. | 52/426 |
| 6,609,340 | B2 | * | 8/2003 | Moore et al. | 52/309.11 |
| 6,668,503 | B2 | * | 12/2003 | Beliveau | 52/426 |
| 7,028,443 | B2 | * | 4/2006 | Bennett et al. | 52/686 |

FOREIGN PATENT DOCUMENTS

| | | |
|---|---|---|
| BE | 873.335 | 2/1979 |
| CA | 2087191 | 7/1991 |
| DE | 19949419 | 5/2000 |
| FR | 2 690181 | 10/1993 |
| FR | 2 808543 | 11/2001 |
| GB | 2136847 A | 9/1984 |
| GB | 2 143560 | 2/1985 |
| WO | WO 83/04423 | 12/1983 |
| WO | WO 90/15205 | 12/1990 |
| WO | WO 98/31887 | 7/1998 |

* cited by examiner

BUILDING BLOCKS AND LOCATION DEVICES FOR REINFORCED CONCRETE WALLS

TECHNICAL FIELD

The invention concerns building blocks for the construction of concrete walls. The invention also concerns location devices for the interconnection of building blocks and/or support of reinforcement rods in a concrete wall. Furthermore, the invention also concerns a wall and a method of constructing a concrete wall using building blocks and location devices.

BACKGROUND ART

Known hollow building blocks are used to make reinforced concrete walls. In general these blocks are laid using staggered bond to ensure a good connection and to provide shear strength between the blocks. The hollow core of the wall is then filled with vertical steel reinforcing rods and concrete grout. A problem arises in aligning the blocks using staggered bond since they are not made with uniform height. Therefore, mortar is used between the blocks to accommodate this difference in height.

In order to eliminate mortar, Australian Patent No 692868 proposes the use of blocks having slotted ends, and keys to lock the ends of the blocks together. Additional courses are then added in stack bond, and the keys extend between adjacent courses so that each key locks four blocks in place. In the resulting structures there are vertically extending hollow voids to receive reinforcing steel and concrete. However, it is difficult to provide for horizontally arranged steel or horizontal concrete flow in such a wall.

DISCLOSURE OF THE INVENTION

According to a first aspect, the invention is a building block comprising two side panels with at least one open end, the side panels spaced apart by two bridging parts, a removable section on at least one bridging part, and a pair of recessed or protruding formations on opposite inner faces of the open end of the side panels to enable building blocks to be interconnected.

The interconnection of building blocks may use a location device. The removable section of the bridging part may be the top portion of the bridging part.

Further parallel recessed or protruding formations may be provided on opposite inner faces of the side panels, such as on the other end of the side panels and/or on the center of the side panels. The recessed or protruding formations may extend vertically down the inner faces of the side panels. The recessed or protruding formations not at the ends of the side panels may be arranged in opposing sets of four. These further formations provide additional positions where additional location devices can be used.

A bridging part may close one end of the block. Additional bridging parts may be provided in between the two bridging parts.

Vertical extending cavities may be formed between the side panels and the bridging parts of the block. Such as both within the block and between two blocks laid end to end to allow vertical reinforcing steel rods to be installed and the vertical flow of concrete.

Further removable sections may be provided on all the bridging parts. The resulting lateral extending cavity may allow lateral steel reinforcing rods to be installed and the lateral flow of concrete.

The combination of the lateral and vertical cavities allows the blocks to hold both lateral and vertical steel reinforcement rods, as well allowing concrete grout to flow both ways. A wall constructed in this manner creates a reinforced concrete panel within the blocks.

The bridging part closing the other end of the block may include a pair of parallel vertical groves that allows the area of the bridging part between the grooves to be removed. A section of the side panel adjacent to the closed end of the block may include a pair of parallel vertical groves that allows the area of the side panel between the grooves to be removed. These additional removable sections enable a horizontal cavity to extend through corners and intersections of a wall comprised of blocks.

Longitudinally extending stepped recesses may be included on the bottom of the outer faces of the side panels, the recesses are sized to receive the top of a side panel of a block positioned underneath.

The width of the side panels may be equal to the width of the protruding formations.

The top of the side panels may be bevelled to aid the flow of concrete between the lateral edges of building blocks arranged in a wall.

According to a second aspect, the invention is a location device comprising two members spaced apart by cross members, where the two members extend beyond the cross members to engage with formations of one or more building blocks. Such a locative device may support reinforcement rods or may enable adjacent building blocks arranged in a wall to be interconnected.

The members and the cross members may define at least one vertical cavity.

The location device may further include a bottom member spanning the area between the two members and cross members, the bottom member defining a circular aperture.

The location device may further comprise at least one pair of vertical projections on the top of the members which may receive a reinforcing rod parallel to the cross members. Further vertical projections may be provided so that the reinforcing rods can be positioned at varying distances from the cross members, so that the correct distance can be selected. The vertical projections click the steel reinforcement rods into position so that the rods then holds the blocks together and in correct alignment.

The location device may be made with a resilient material so that the cross members are flexible. With such a construction, the location device can be easily fitted into place by pressing on the cross members together, and then releasing once in position. The resilient material may be water resistance so as to form a membrane down the space between two blocks laid end to end to inhibit water penetration.

The extensions to the members may form a straight line, alternatively the extensions of the members beyond the cross members may on different planes, with the members positioned closer together.

The blocks interconnected by the location device may be arranged in a stagger bond or stack bond formation. The building blocks may comprise the features described above.

The location device may engage formations of a building block by the extensions of the members beyond the cross members slotting into a set of four recessed formations included in the inner faces of the building block. Alternatively, the extensions of the members beyond the cross members may clamp the sides of protruding formations included on the inner faces of the block.

The location device may engage formations of building blocks to interconnect them by engaging with formations included at the ends of the blocks. The extension of the members beyond the cross members may slot into a set of four recessed formations created when two blocks are positioned end to end. Alternatively, the extension of the cross members beyond the cross members may clamp the sides of two opposing pairs of protruding formations created when two blocks are positioned end to end. The interconnection of blocks through the location device prevents the blocks arranged in a wall from dislodging.

Furthermore the location device may further comprise positioning means to align a block positioned above the building block which is fitted with the location device. Such a positioning means may comprise a ledge provided on the outer face of each of the cross members and is sized to abut a top surface of a building block fitted with the location device, and the bottom surface of another block above it. The ledge may act as a platform to hold blocks positioned above at a correct height despite the discrepancies in the height of the blocks below.

In addition, the location device may provide guide means for guiding an inner face of a building block when placing it in position on top of a building block fitted with the location device. The guide means may include the upper end of the extension of the two members beyond the cross members and may also include ribs provided on the outer face of the cross members above the ledge.

In a further aspect, the invention is a wall comprised of the building blocks and location devices described above, and arranged in either stack or stagger with the location devices interconnecting the building blocks. The interconnection of the blocks may be as described above.

According to another aspect, the invention is a method of constructing a reinforced concrete wall comprising the above described building block and location device, comprising the steps of:

laying a first course of the blocks to a height line forming a bed-joint to bring the blocks to an accurate height and length, the blocks laid end to end without the aid of mortar;

as required, placing location devices between blocks at the ends of the side panels and/or at a corner of the wall and/or between ends of the side panels;

as required, removing the removable sections of the blocks and fitting lateral steel reinforcement rods to the location devices;

repeating the steps of laying a further course of blocks above of the laid course, placing location devices and fitting lateral steel reinforcement rods as required until the desired height of the wall is created; and filling the blocks with concrete grout as required.

The method may further comprise bringing the blocks into more accurate alignment through the fitting of the lateral steel reinforcement. The method may also comprise the laying of the blocks so as to create a space therebetween for tolerance. The method may also include the insertion of vertical steel reinforcement rods, as required. The location device holds and ties the lateral reinforcement steel in a specified position within the core of the block enabling a structural engineer to design a load-bearing concrete wall within the concrete block of either a stagger bond or stack bond building pattern.

These and further advantages of the invention will become apparent in the following description.

BRIEF DESCRIPTION OF THE DRAWINGS

Examples of the present invention will now be described with reference to the accompanying drawings, in which.

BEST MODE FOR CARRYING OUT THE INVENTION

Figure 1:
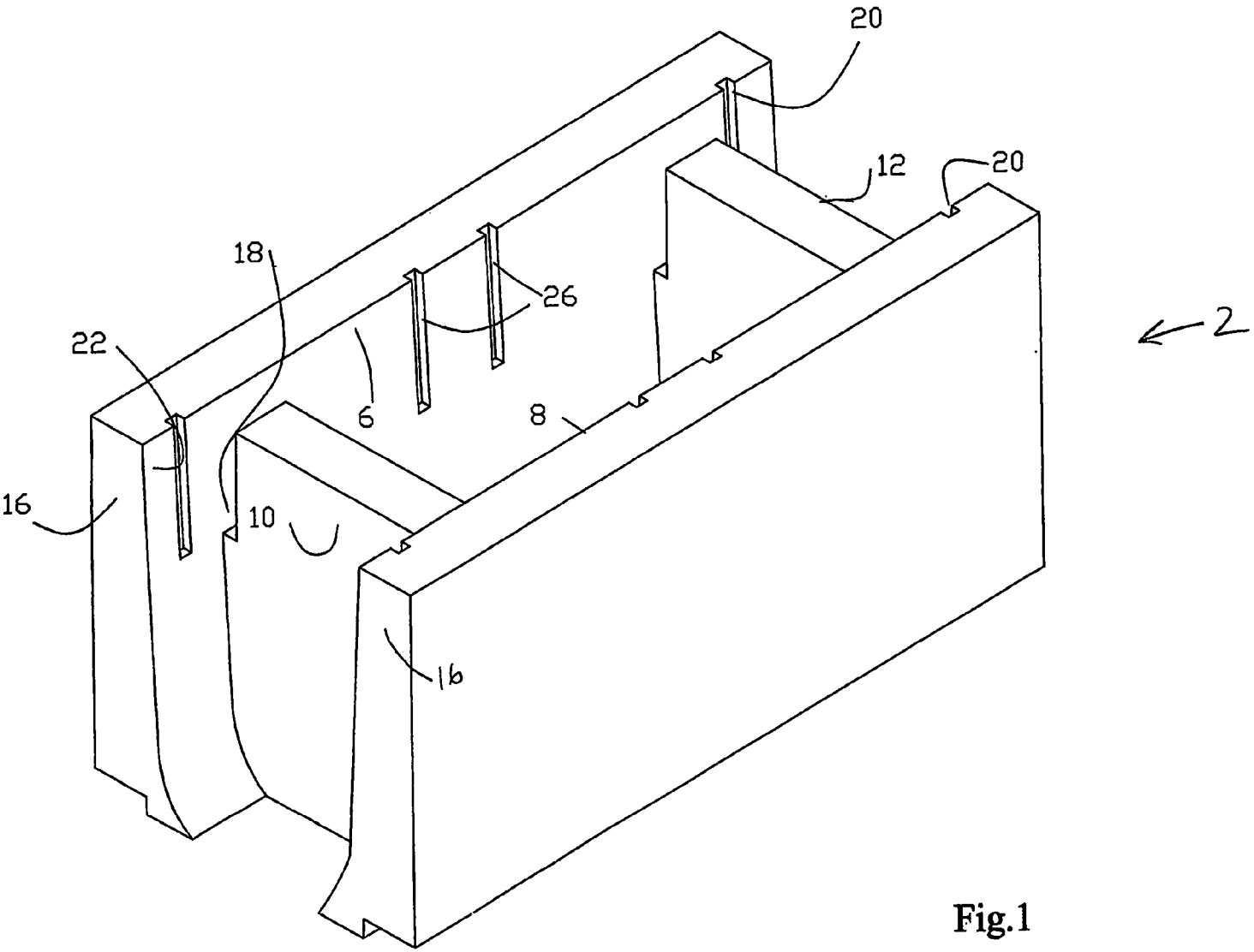
FIG. 1 is perspective view of a first building block.
Figure 2:
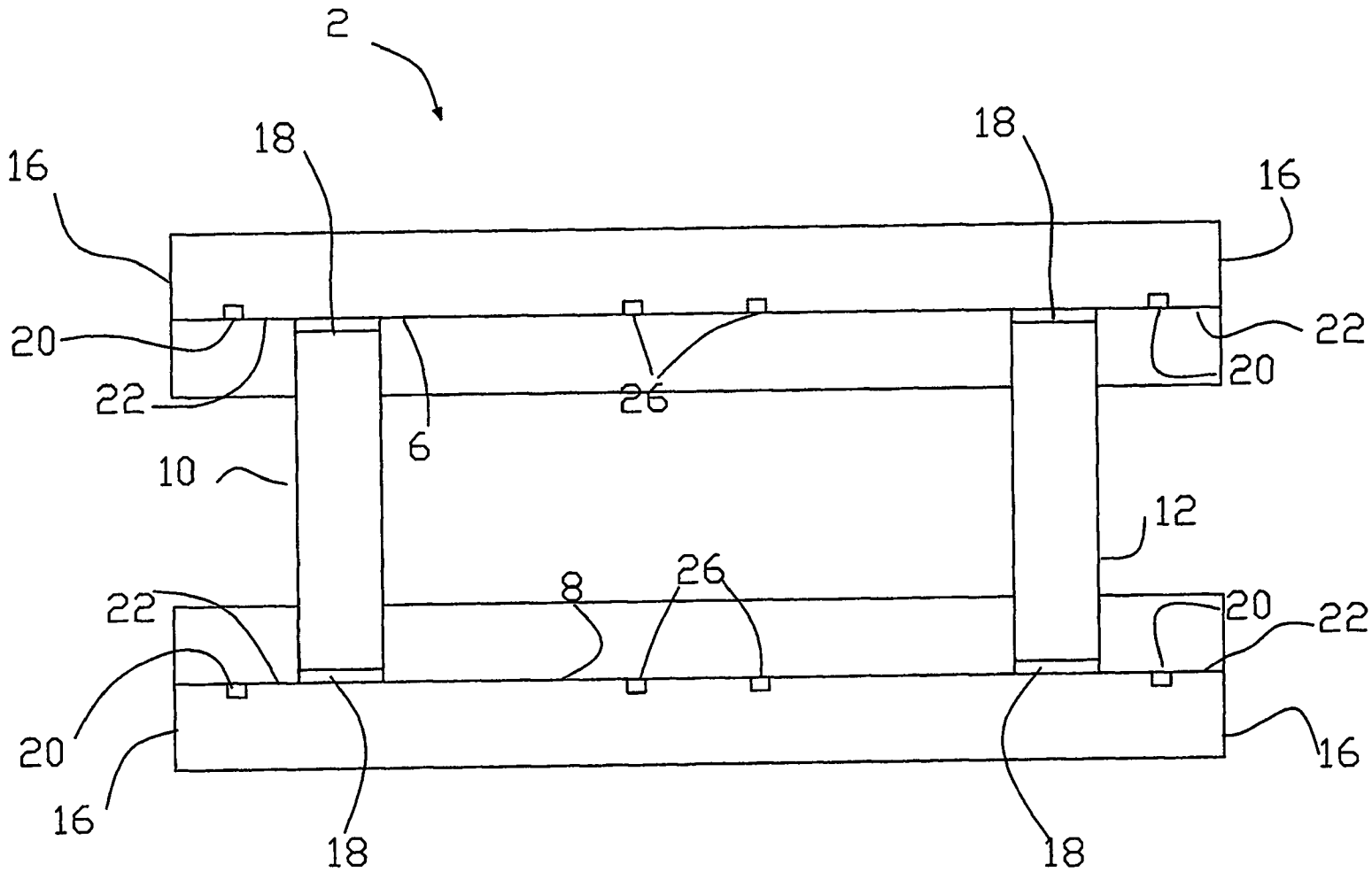
FIG. 2 is a plan view of the first building block.
Figure 3:
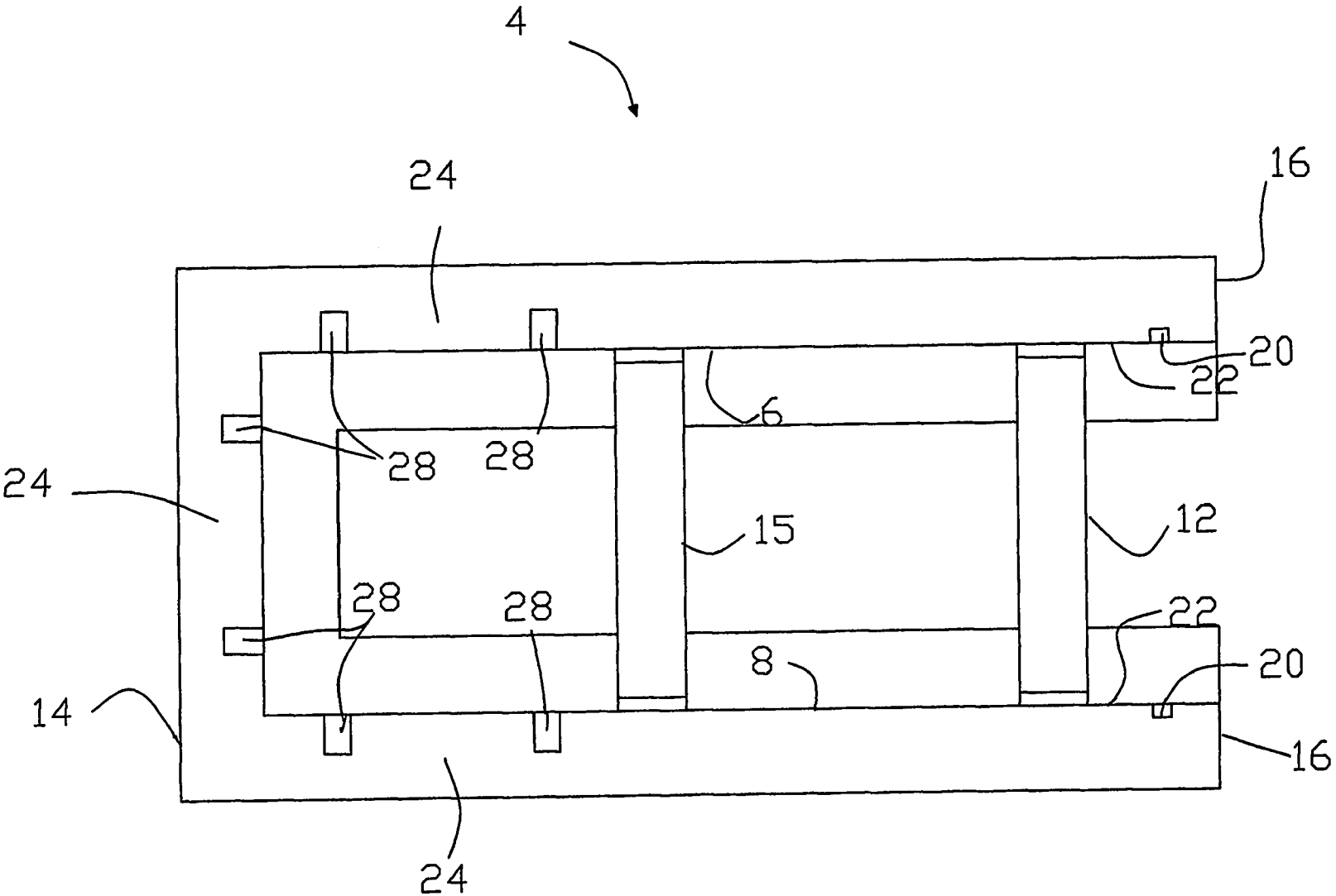
FIG. 3 is a plan view of a variant of the first building block, for use at the corners or ends of a wall.

FIGS. 1 and 2 show a first building block 2 for use in building walls. Block 2 has two side panels 6 and 8 and open ends. The inside faces of the side panels 6 and 8 of the block are inclined to allow for easy release from the mould during manufacture. Bridging parts 10 and 12 span between side panels 6 and 8 adjacent respective ends. FIG. 3 shows a variant of the first building block 4 for use at the corners or ends of a wall. Block 4 has one bridging part 12 similar to FIG. 1, but the other end 14 is modified to close the end of the block. An intermediate bridging part 15 spans the middle of block 4. The vertically extending cavities formed between the panels and bridging parts of the blocks 2 and 4 allow for the vertical insertion of reinforcing rods and for concrete flow.

The blocks 2 and 4 are similar in size to a standard concrete block. However, unlike the standard block, at least one of the ends is open with the bridging part 10 or 12 positioned back from the ends 16 of the panels 6 and 8. Adjacent the recessed ends of the blocks, end slots 20 extend vertically down the inner faces 22 of the panels 6 and 8. The slots 20 are arranged in opposing pairs and are spaced a predetermined distance from the ends 16 of the panels. Moreover pairs of intermediate slots 26 extend vertically down the inner faces 22 of the panels 6 and 8 between the bridging walls. These pairs of slots are also formed in opposed sets of four at predetermined spacing along the inside faces 22 of the panels 6 and 8. The positioning of the slots 20 is determined so as to enable the blocks to receive a location device which will be described in detail later.

Figure 4:
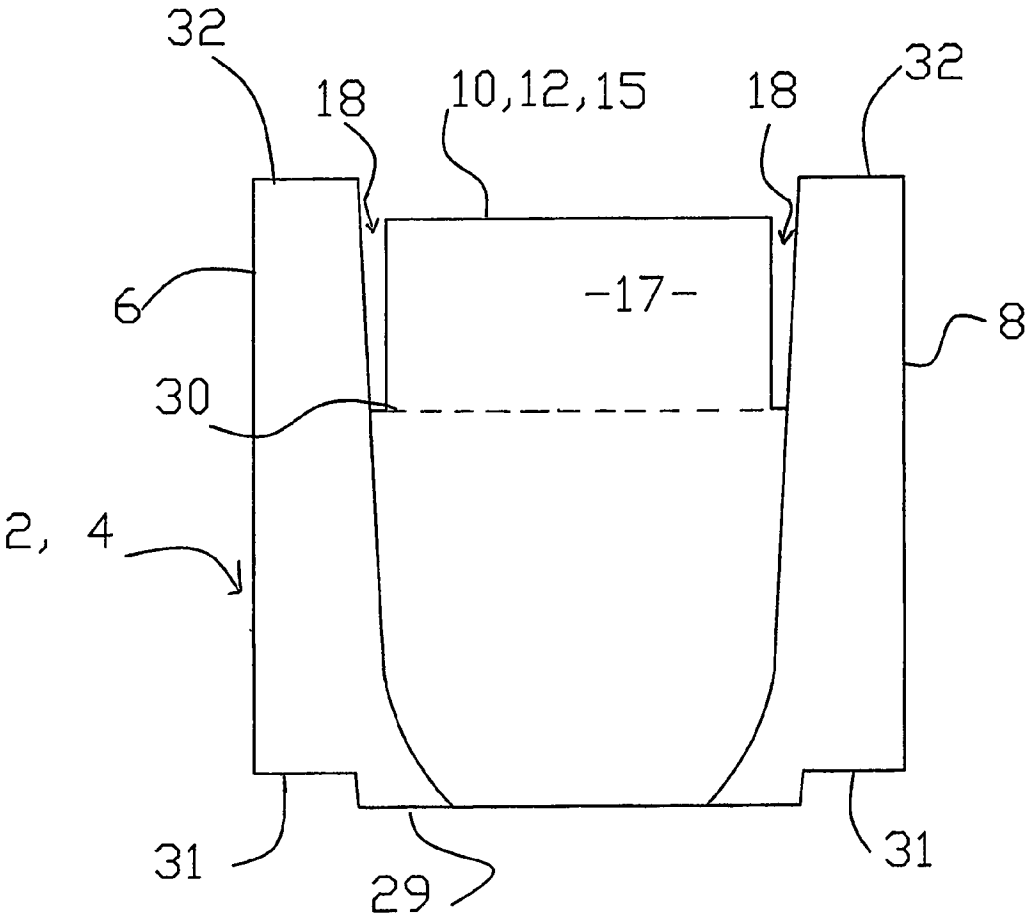
FIG. 4 is an end view of the building blocks of FIGS. 1, 2 and 3.

FIG. 4 shows that the tops of the bridging parts 10, 12 and 15 are made in such a way as to allow them to be broken out. Apertures 18 extend approximately 80 mm down from the top of panels 6 and 8 to define a removable section 17 which breaks away along the broken line 30. This allows the creation of a horizontally extending cavity inside a wall made using the blocks, that can accommodate reinforcing rods and concrete flow.

Furthermore in the block 4 of FIG. 3, deep grooves 28 are formed in the panels 6 and 8 and the end 14, to allow any combination of sections 24 to be broken out of the closed end or sides of the block. Removal of sections 24 enables horizontal insertion of steel reinforcing rods and concrete flow, and is useful depending on the location of the block, as will be described later.

As shown in FIG. 4, the blocks 2 and 4 are also formed with longitudinally extending stepped recesses 31 along the bottom 29 of the outer faces of the panels 6 and 8. The recesses 31 are large enough to receive an upper edges 32 of an underlying block, and provides a means for aligning the blocks and holding them in position.

Figure 5:
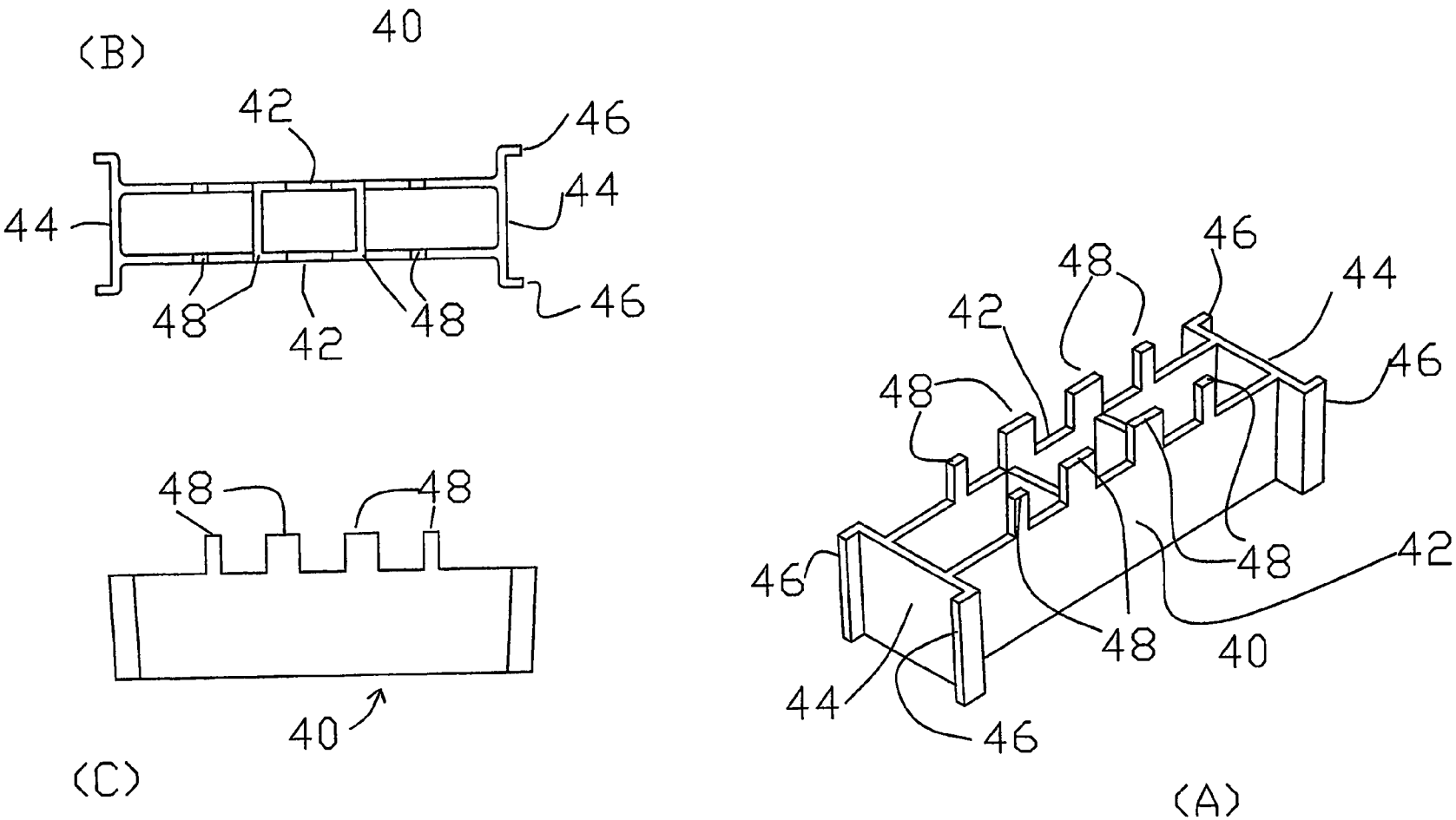
FIGS. 5(*a*), (*b*) and (*c*) are perspective, plan and side views respectively of a first location device for use with the building blocks of FIGS. 1, 2, 3 and 4.

FIGS. 5(*a*), (*b*) and (*c*) show a location device 40. The location device 40 may be made of any suitable material to serve its purpose, in this case it is moulded in a plastics material. The location device 40 comprises two members 42 spaced apart by cross-members 44. The cross-members 44 are slightly inclined from the vertical so that they lean outwards. The ends 46 of members 42 extend beyond cross-members 44 and are on a different plane to the members, the members being positioned closer together. The extension of the members are sized to enter the slots 20 or 26 of the blocks 2 and 4. The length of the members 42 allows the device 40 to span between the side panels 6 and 8 of the building blocks 2 and 4. The length of the cross-members 44 allows the ends 46 of members 42 to enter a set of four slots 26, and a set of four slots 20 formed when two blocks are positioned end to end. Pairs of vertical projections 48 along the tops of members 42 are designed to receive steel reinforcing rods 50.

Figure 6:
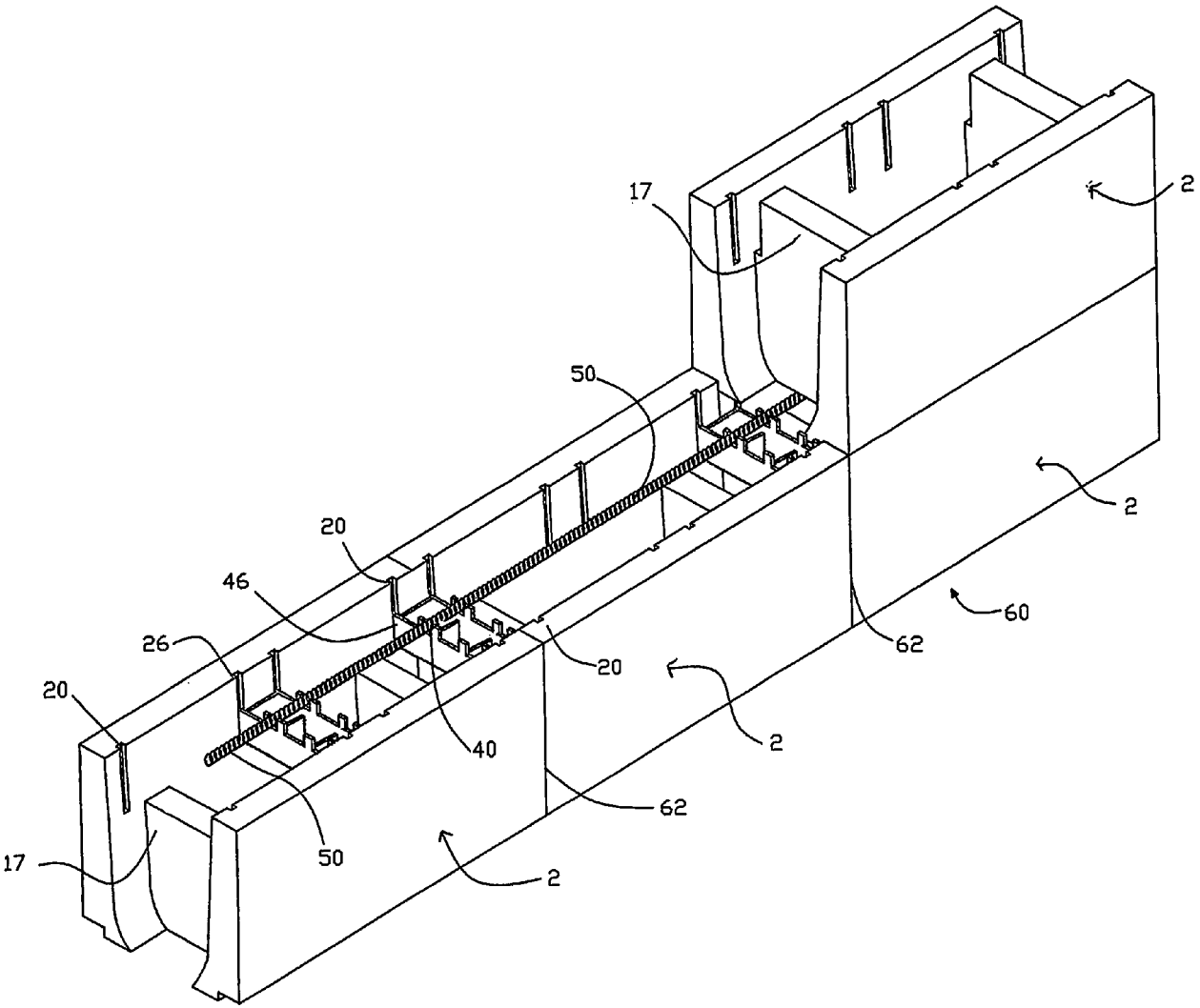
FIG. 6 is a perspective view showing the blocks of FIGS. 1, 2 and 4 and the location devices of FIG. 5 assembled together to form part of a wall.

As shown in FIG. 6 a straight block wall 60 is constructed by laying blocks 2 end to end to each other without the aid of mortar. Between each pair of blocks is a perpendicular space, or joint, 62. The break out sections 17 of the bridging parts 10 and 12 are removed as required. The location devices 40 are then placed in position between each of the adjacent blocks, guided by the edges of the four extensions 46 which fit into opposing pairs of slots 20. The edges of extensions 46 are vertical, but could be slightly inclined to assist in their insertion if required. The inclined faces of the cross-members 44 of the location device 40 are manually forced down into the block, aligning with the sloping inside faces 22. Incidentally, when the block mould wears, the inside of the block cavity or core diminishes in size. By having the end cross members 44 appropriately inclined, the location device 40 can still be inserted, but at a slightly higher position.

Figure 7:
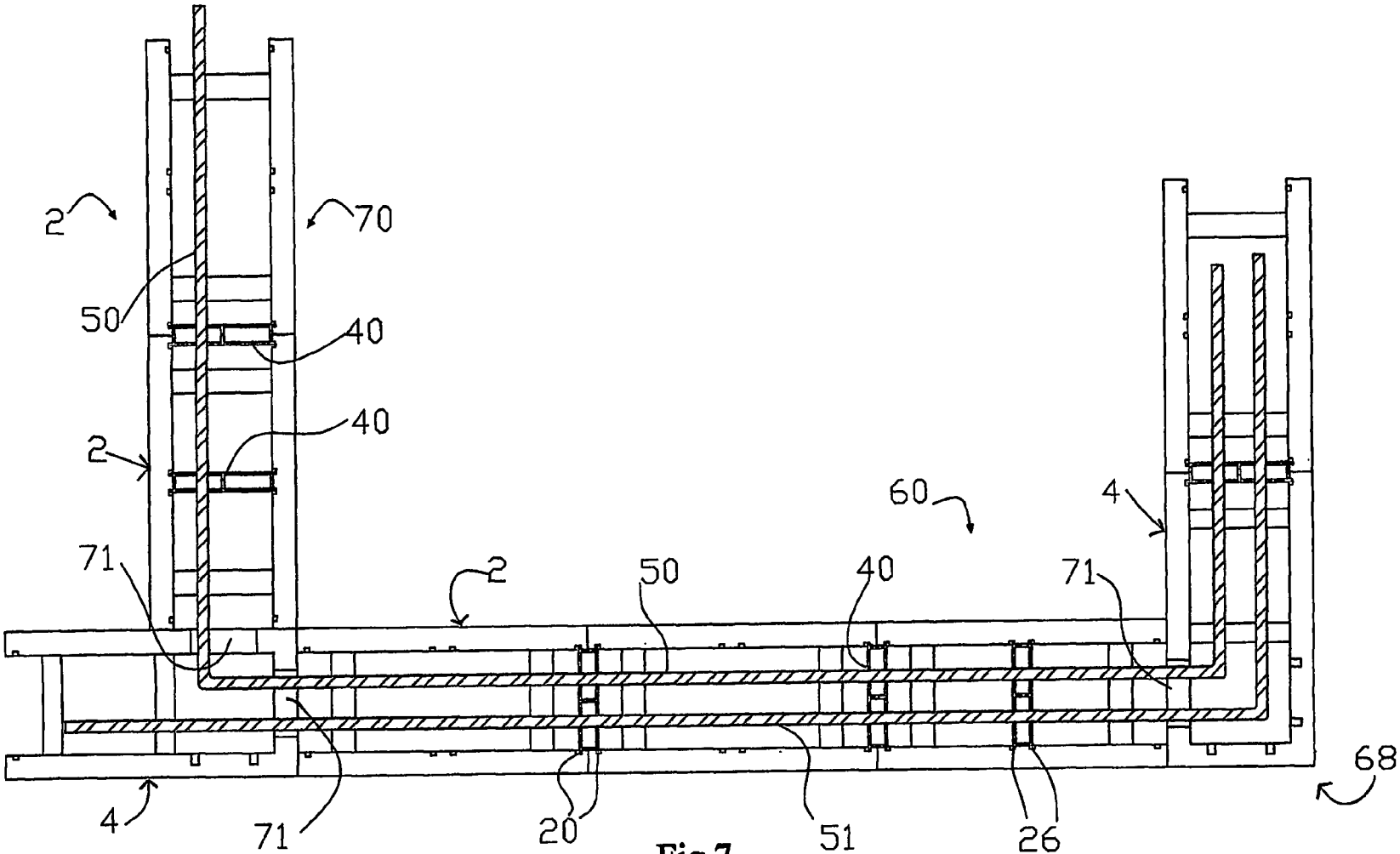
FIG. 7 is a simplified plan view showing the blocks of FIGS. 1, 2, 3 and 4 and the location devices of FIG. 5 assembled together to form part of a wall.

A more complex wall is shown in FIG. 7, where both blocks 2 and 4 are used to make a wall 60 with a corner 68 and an intermediate wall 70. In this case one or more of the break out sections 24 are removed from block 4 to form openings 71 and create horizontal channels around the corner 68 and between the intermediate wall 70 and wall 60. The resulting wall comprises a series of blocks 2 and 4 held together end to end by the location devices 40. Steel reinforcing rods 50 and 51 are then laid inside the wall channel, along its length, and are received between pairs of projections 48 in successive location devices 40. Each pair of projections 48 firmly clamp against the sides of 12 mm deformed steel rods 50 and 51. Additional location devices 40 may be placed in slots 26 to provide additional support for the steel reinforcing rods 50 and 51.

When the blocks have been laid to the full length of the walls 60 and 70, and the reinforcing rods 50 and 51 have been clipped to the location devices 40 over the entire length of the walls 60 and 70, the rods 50 and 51 and the blocks 2 and 4 are locked together, making it extremely difficult to separate. But more importantly, the rods 50 and 51 are locked into the walls 60 and 70 at precisely the correct location stipulated by the building code, giving the wall great strength. Concrete grout may then be used to fill the wall, and it will flow horizontally along the block course and around the corners through the broken out sections.

Figure 8:
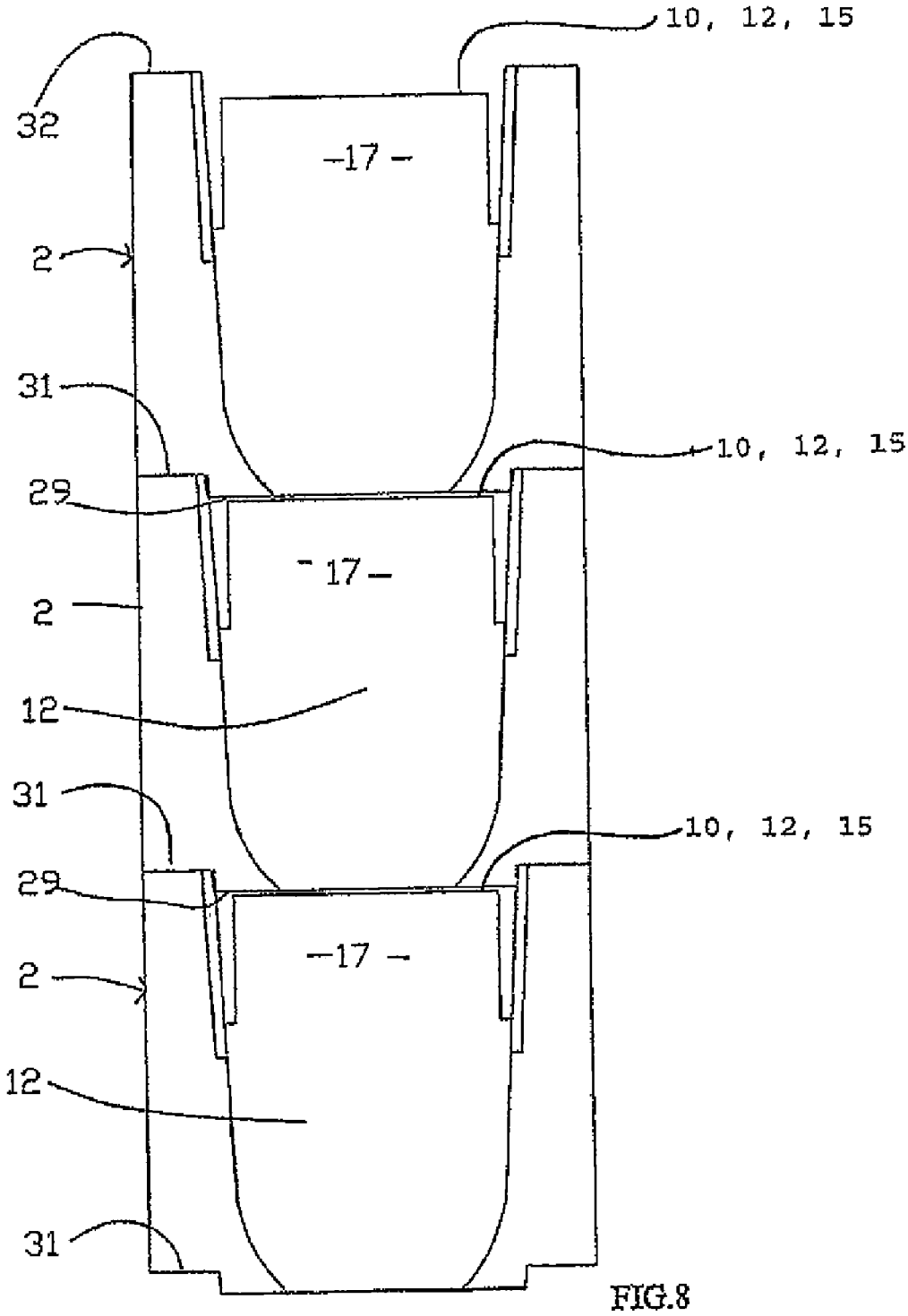
FIG. 8 is an end view of three of the blocks of FIGS. 1, 2, 3 and 4 stacked one above another in a wall as shown in FIG. 6 or 7.

When the next course is laid, the blocks are positioned on top of the laid layer in a similar manner. Moreover, the engaging recesses 31 along the bottom faces 29 of the blocks 2 and 4 are fitted over the upper edges 32 of the laid blocks 2 and 4 to facilitate alignment. In this case the bottom face 29 fits into the space above the top of the bridging walls 10, 12, 15. This is more clearly shown in FIG. 8, which illustrates the stacking arrangement.

Figure 9:
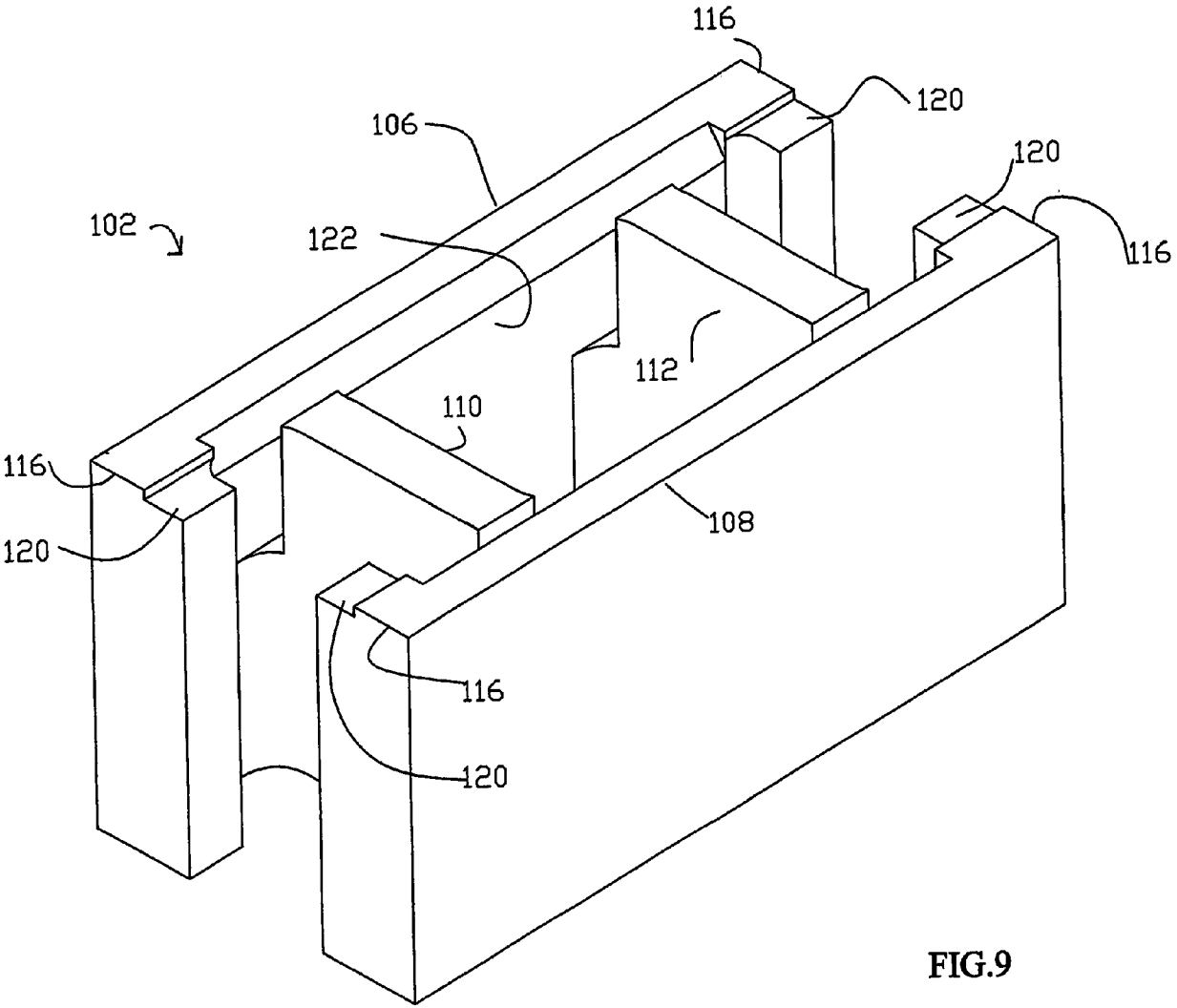
FIG. 9 is a perspective view of a second building block.
Figure 10:
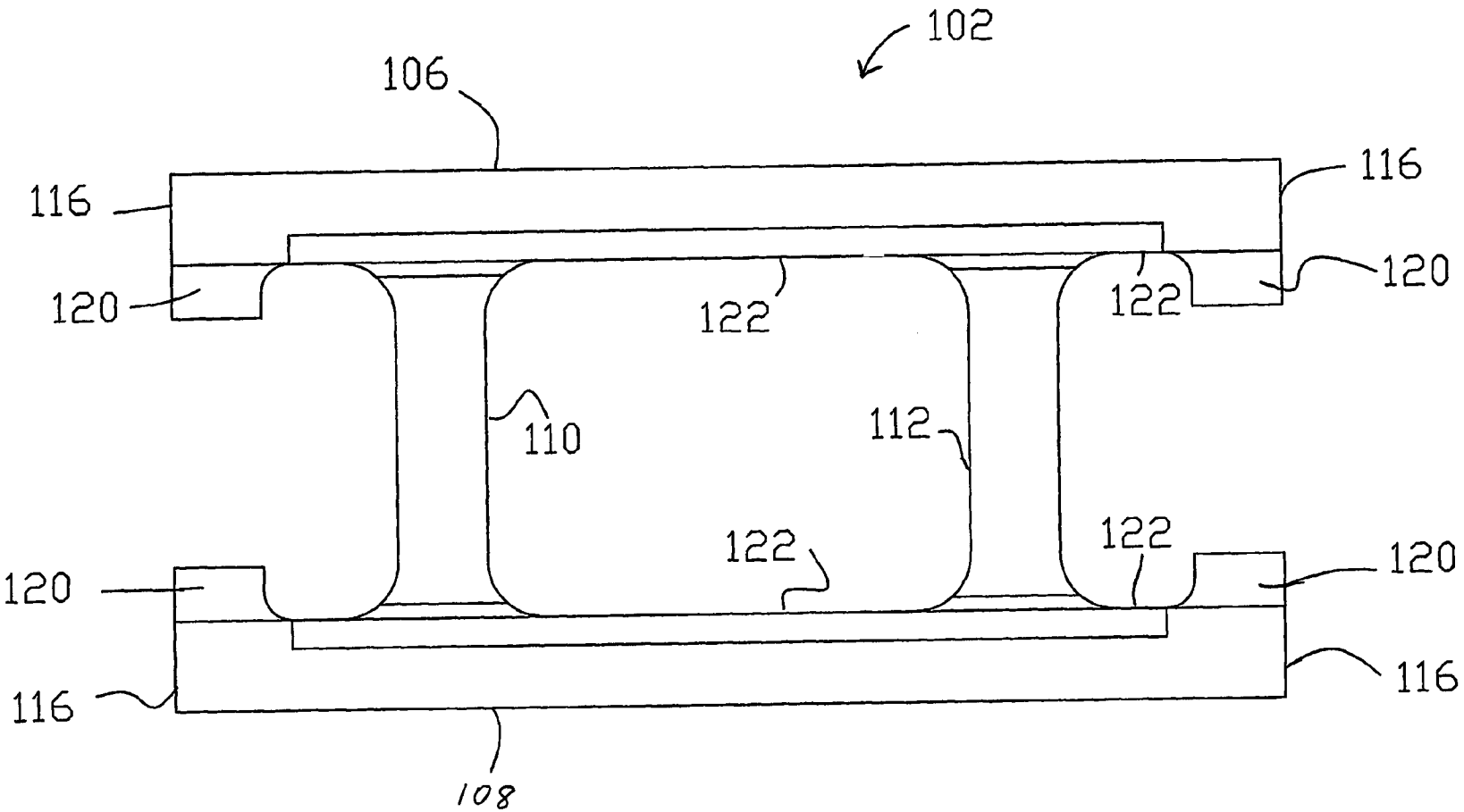
FIG. 10 is a plan view of the building block of FIG. 9.

Next is a description of a second example with reference to FIG. 9 through FIG. 21. FIG. 9 and FIG. 10 shows a second building block 102 for use at intermediate locations of a wall that has two side panels 106 and 108 with open ends. Bridging parts 110 and 112 span between the side panels 106 and 108 adjacent at respective ends.

Figure 11:
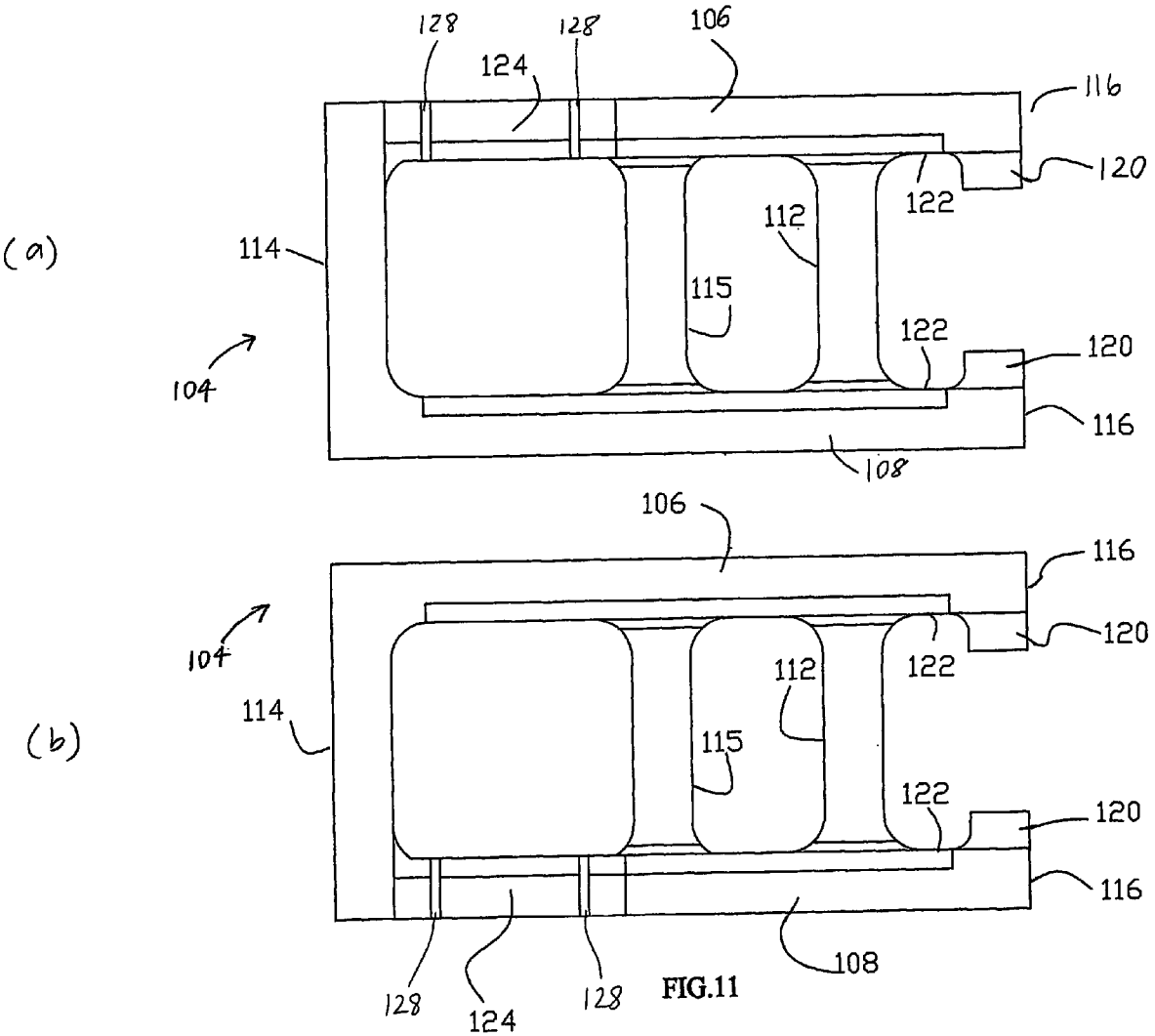
FIGS. 11(*a*) and (*b*) is a plan view of two variants of the building block of FIGS. 9 and 10 for use at corner locations, or for connecting at intermediate locations.
Figure 12:
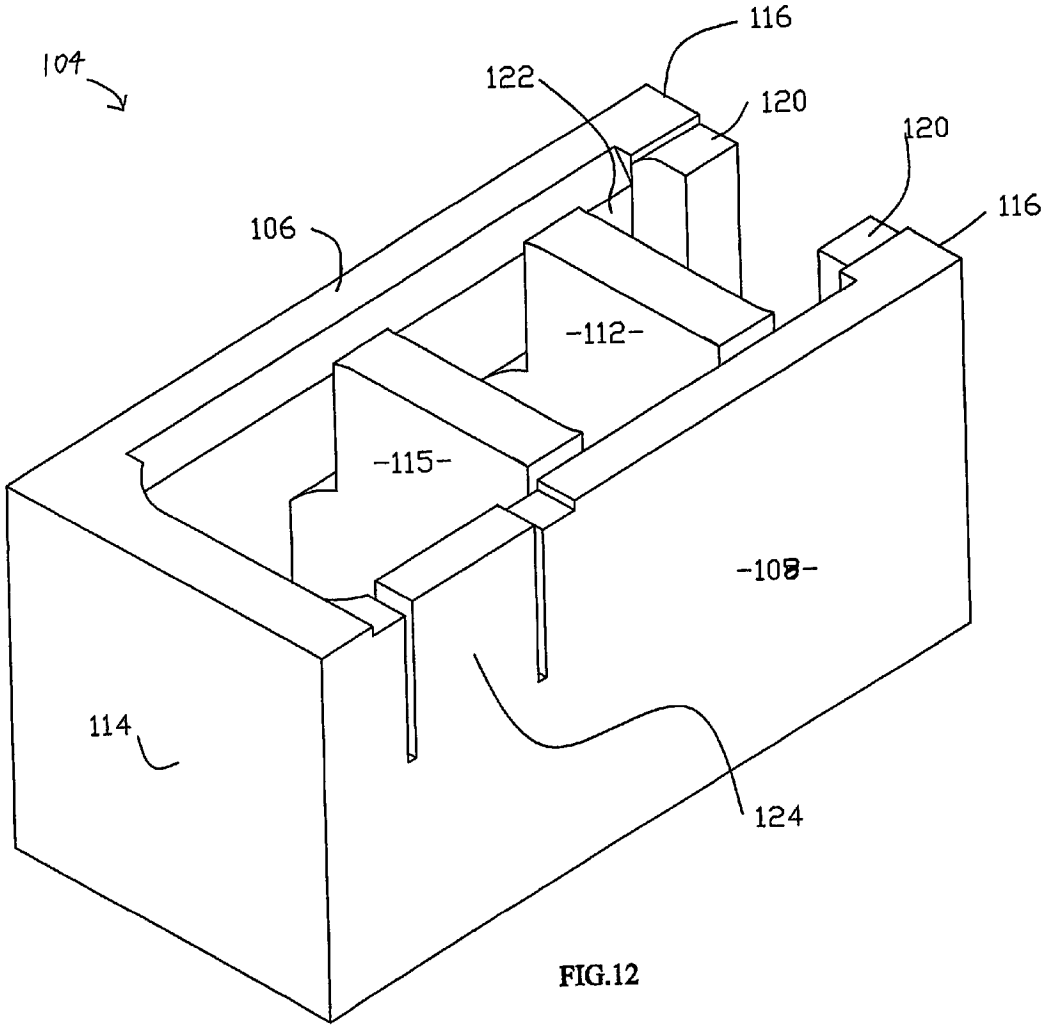
FIG. 12 is a perspective view of one of the building block of FIG. 11.

Blocks 104 of FIGS. 11 and 12 show variants of block 102 for use at corners, intersections, or ends of walls. Block 104 is either a right or left block, each having a bridging part 112 at one end and the other end is closed 114. A further intermediate bridging part 115 is also provided. The right block 104 of FIG. 11 (*a*) has deep grooves 128 formed in panel 106 between the end 114 and bridging 115 parts of the block. Grooves 128 allows section 124 to be broken out to create horizontal cavities around corners or intersections of walls. The left block of FIG. 11(*b*) and FIG. 12 is a mirror image of FIG. 11(*a*) allowing section 124 to be broken out of side panel 108.

The blocks 102 and 104 are similar in size to a standard concrete block. At least one end is open with the bridging part 112 positioned back from the ends 116 of the panels 106 and 108. Pairs of protrusions 120 extend perpendicularly and vertically from the inside faces 122 at the ends 116 of the panels 106 and 108. These protrusions 120 replace the slots 20 of blocks 2 and 4 and enable the blocks to receive a location device which will be described in detail later.

Figure 13:
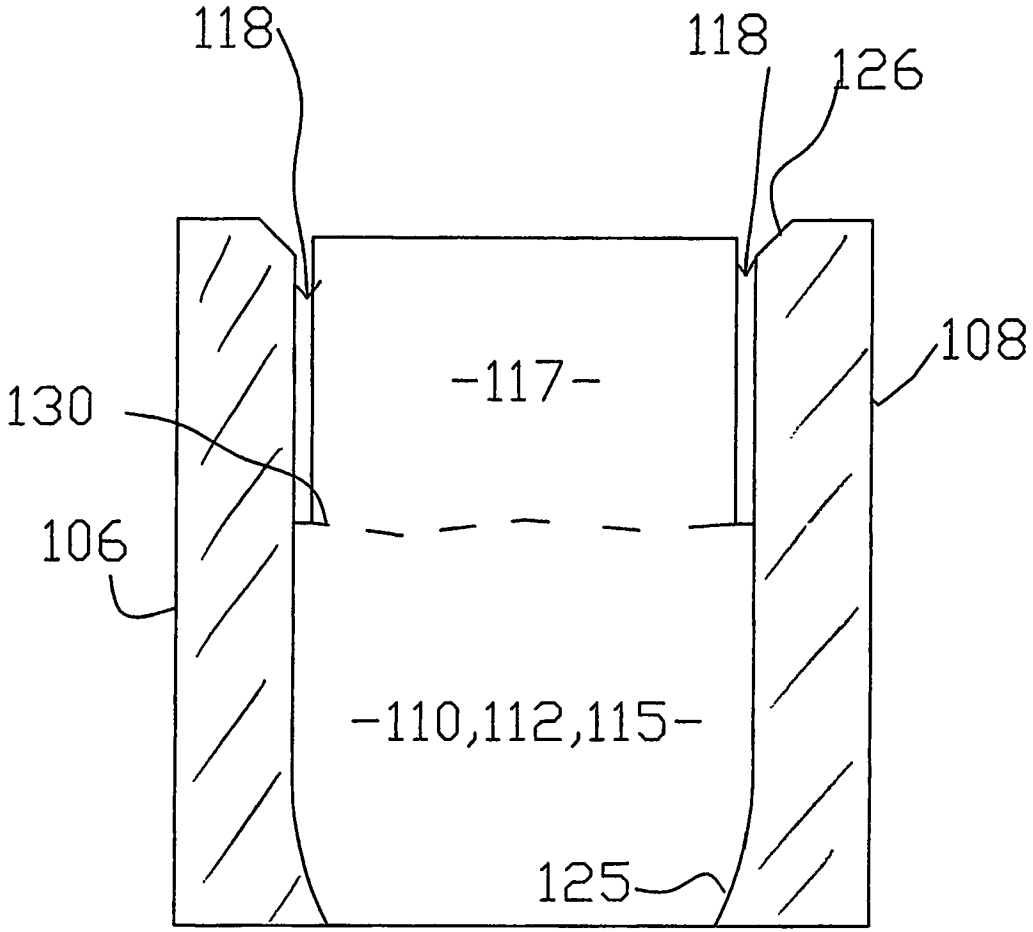
FIG. 13 is a sectional view of the building block of FIGS. 9, 10, 11 and 12.

As shown in FIG. 13, like blocks 2 and 4, the bridging part 110, 112 and 115 can be broken out. Apertures 118 extend approximately 80 mm down from the top of the panels 106 and 108 to define a removable section 117 which can break away along broken line 130. This allows the creation of a horizontally extending cavity inside a wall made using the blocks 102 and 104.

FIG. 13 also shows a modified form of the block 102 with curvature 125 at the base of the block which allows the steel mould to release the block during production.

The top of the block is bevelled 126 to encourage the slurry or cement paste to travel between the two blocks 102 ensuring complete filling.

Figure 14:
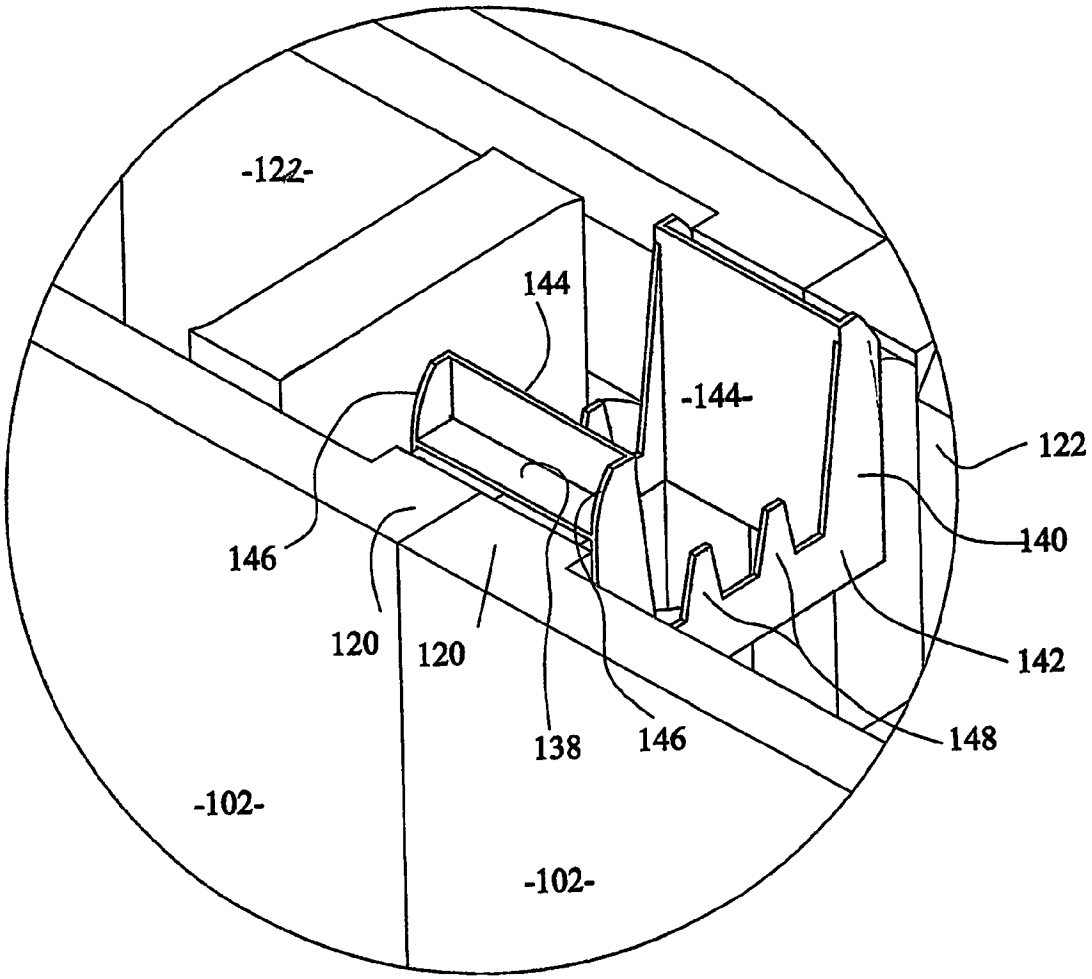
FIG. 14 is a perspective view illustrating a second location device interconnecting two of the blocks shown in FIGS. 9 to 13.

FIG. 14 shows a second location device 140 installed between two blocks 102 laid end to end. The location device 140 comprises two members 142 spaced apart by two cross members 144. The ends 146 of members 142 extend beyond the cross members 144 and receive the protrusions 120 between them. The members 142 span the distance between opposing pairs of protrusions 120, and the cross members 144 extend the width of two adjacent protrusions 120.

Furthermore, a perpendicular ledge 138 is provided on an outer face of each cross member 144. The ledge 138 extends the width of the cross member 144. When the location device 140 is installed, the ledge abuts the top of the protrusions 120 and the bottom surface of ledge 138 abuts the top surface of protrusions 120. The ends 146 of the members 142 above the ledge 138 acts as a nudge lock to help position and hold the bottom of the protrusions 120 from the next course of blocks.

The location device 140 further provides pairs of vertical tapered projections 148 on the tops of members 142. These can receive up to three reinforcing rods of varying diameters which are clicked into position.

Figure 15B:
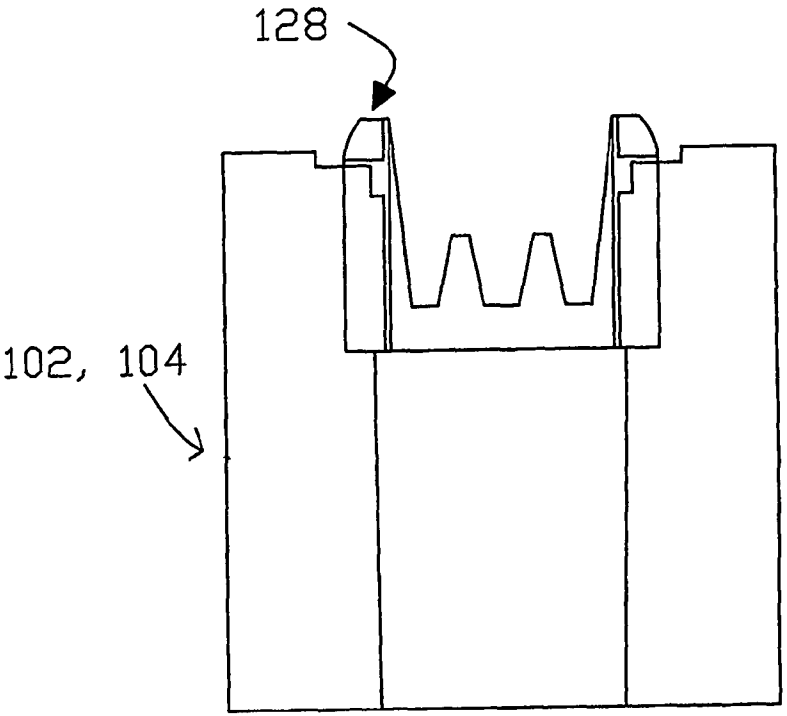
FIGS. 15(*a*) and (*b*) are simplified end views of one of the second blocks and one of the second location devices before and after installation in the block.
Figure 15A:
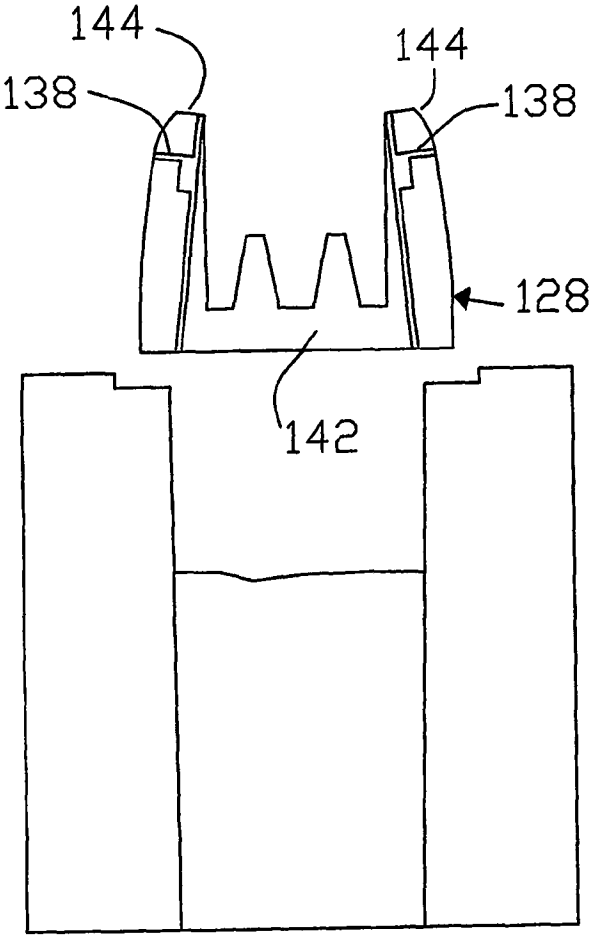

The construction of the location device 140 is made slightly resilient so as to allow a spring effect to hold the blocks 102 and 104 flush with one another when fitted. As shown in FIG. 15(*a*) the locative device 140 can be installed by applying pressure to the cross members 144 so that they are contracted slightly towards each other. The locative device 140 is then lowered inside the block 102 or 104 as shown in FIG. 15(*b*). The pressure to the cross members 144 is released causing the cross members 144 to return to approximately their original position and clamp against the blocks 102 and 104 holding them firmly in place.

Figure 16:
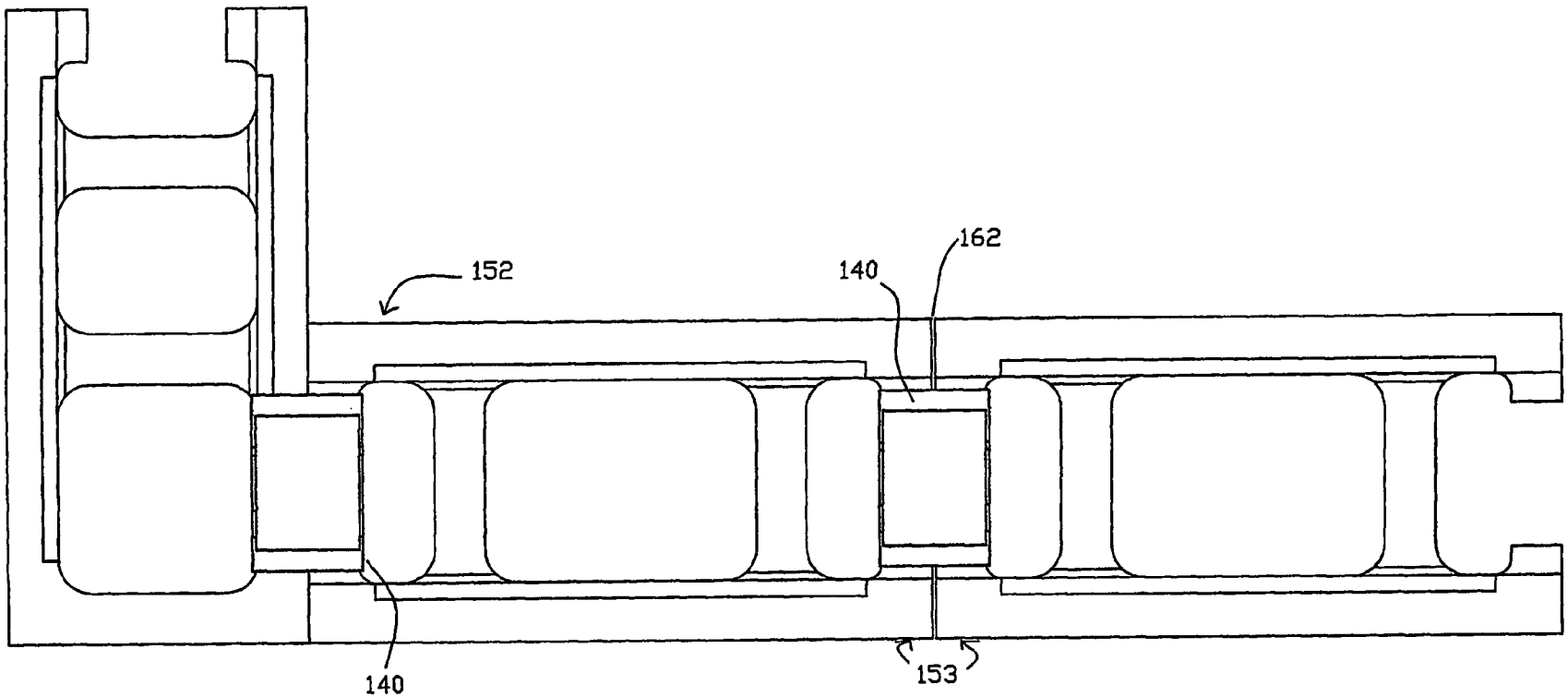
FIG. 16 is a simplified plan view showing the second blocks and the second location devices assembled together to form part of a wall.
Figure 17:
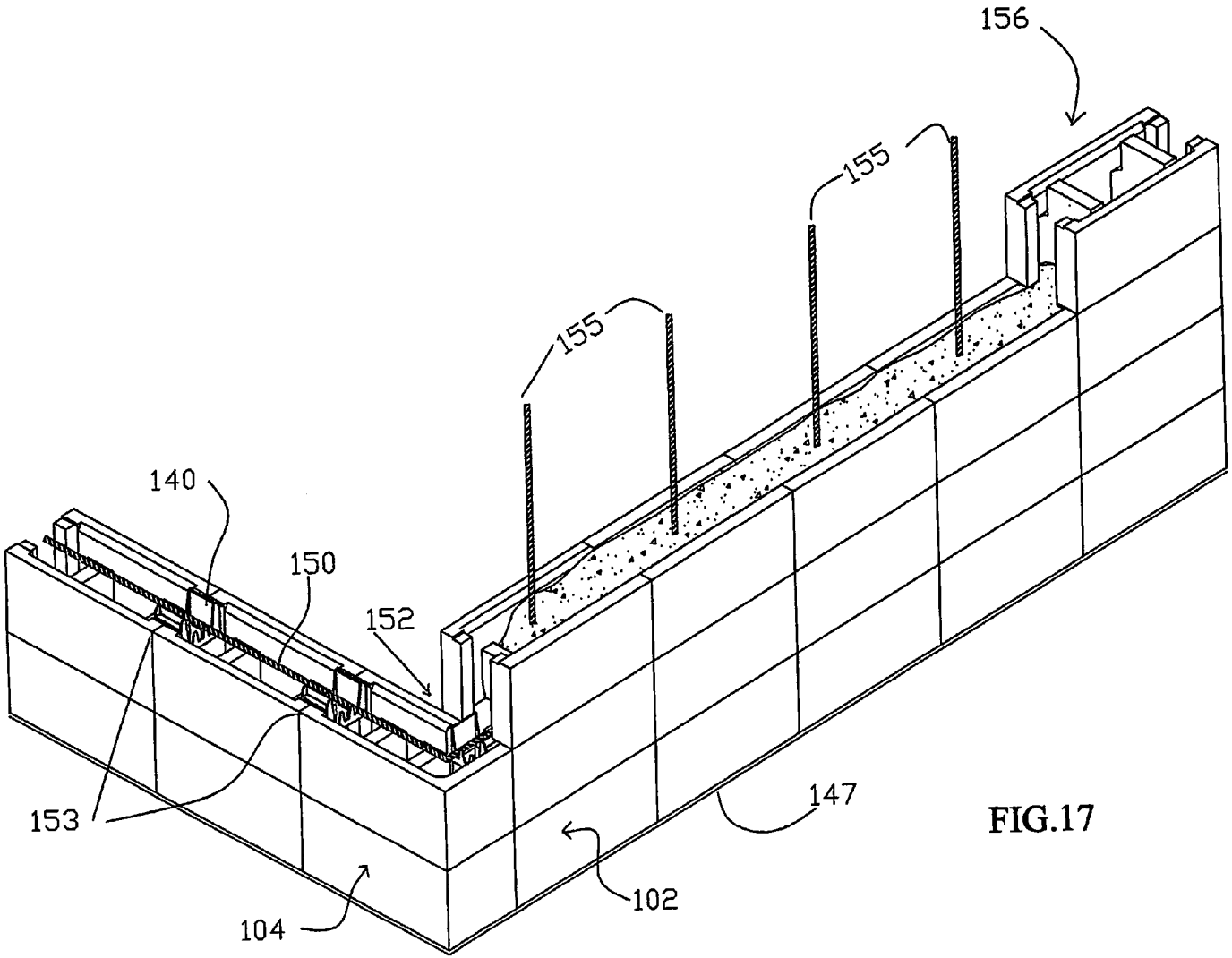
FIG. 17 is a perspective view showing more of the wall of FIG. 16.

A method of constructing a block wall using blocks 102 and 104 and location device 140 will now be described with reference to FIG. 16 and FIG. 17. Initially, the job site is laid out and positions for the blocks 102, 104, doors and windows are marked and profiles installed in each corner for accurate height. Then a first course of blocks 102 and 104 are laid end to end without the aid of mortar. Between each pair of blocks is a perpendicular space, or gap 162 to allow for tolerance. The first course is laid to a height line forming a bed-joint 147 to bring the blocks to accurate height and length.

The location devices 140 are installed between pairs of blocks 102 and 104 in the manner shown in FIG. 15 at each end to end position 153 and at each corner or intersection 152.

Vertical steel reinforcing rods 155 are placed to protrude vertical upward from the center of each block 102 and 104. The plan is checked after the laying of the first course, and if further horizontal support is required, lateral steel reinforcement 150 are placed into it. The steel reinforcement rods 150 also help to bring the blocks into alignment. The reinforcement steel 150 prevents the blocks to which the location device 140 is fitted from any movement until the total wall receives the insitu concrete.

Figure 18:
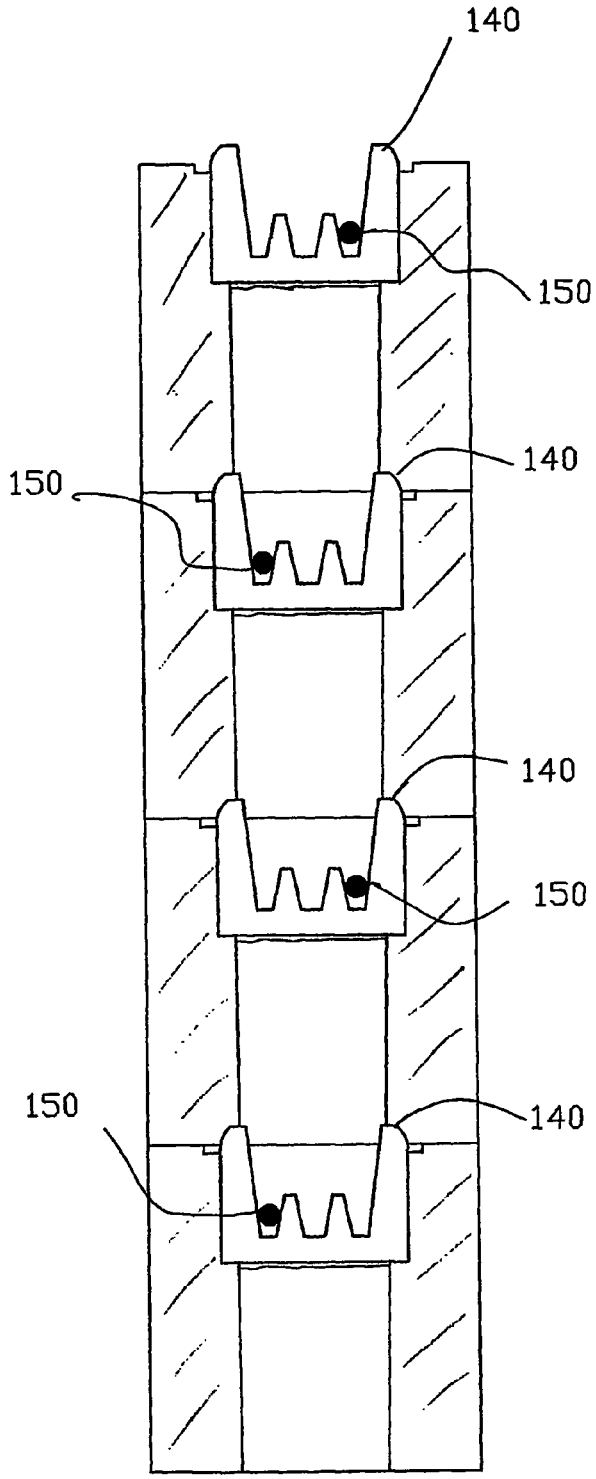
FIG. 18 is a cross section through the wall of FIG. 17 showing horizontal reinforcing rod in the second location devices.

The next course of blocks 156 is then placed directly on top of the blocks below in stack or stagger bond. Further courses are then laid and this is repeated until the desired height is achieved. As shown in FIG. 18, the laying of the next course of bricks are assisted by the location device 140. The formations 120 of the next course of blocks are positioned using the ledge 138, upper end of the cross member 144 and upper end 146 of the members 142 of the locative device 140 as a guide.

The step of checking for the need for additional horizontal support is repeated for each course laid. As the tapered projections 148 of the location device 140 provide three different positions for the placement of the reinforcing rods 150 there is choice is their placement. The cross section of FIG. 18 shows a possible arrangement of the horizontal reinforcing rods 150.

Figure 19:
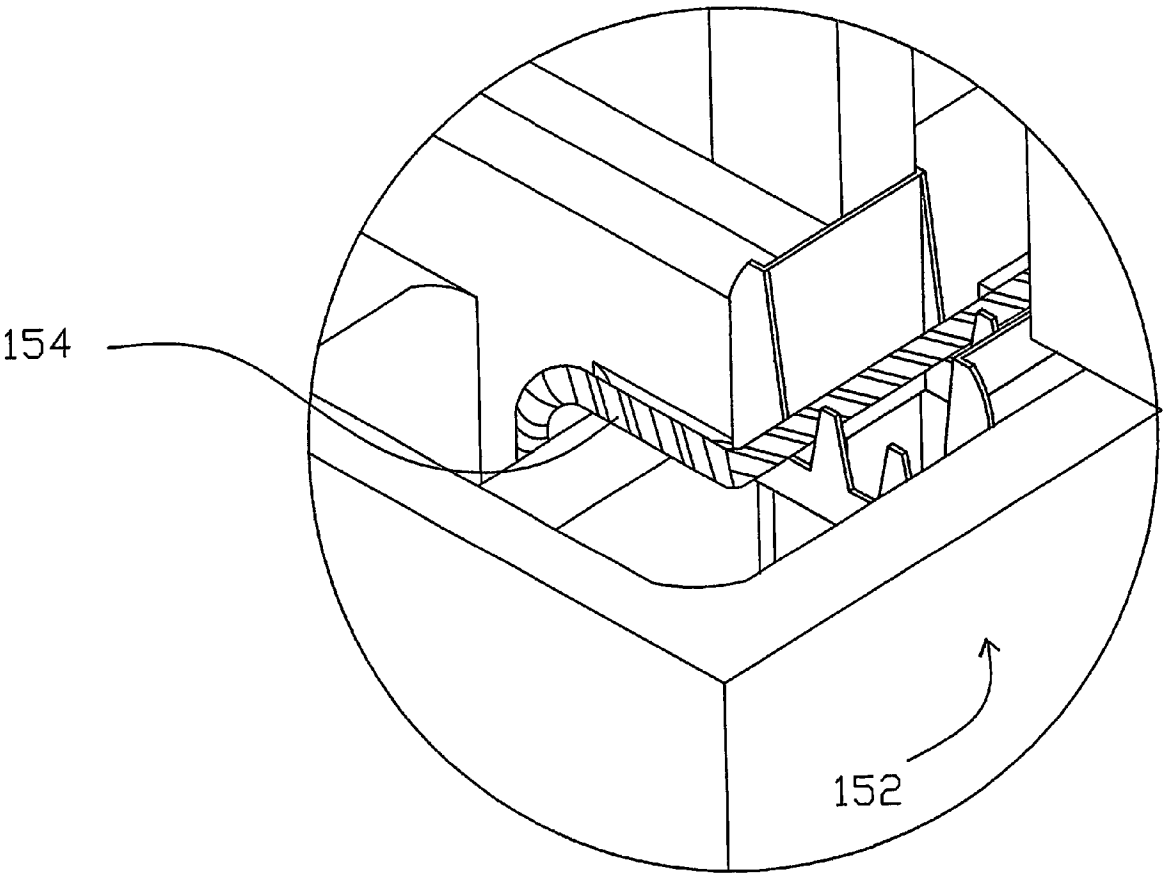
FIG. 19 is a detail showing an arrangement of a reinforcing rod at a corner of the all of FIG. 16.

FIG. 19 shows a possible arrangement of a reinforcing rod for a corner of a wall. A corner steel bar 154 is introduced for extra reinforcement which helps to hold the corner 152 together.

Figure 20:
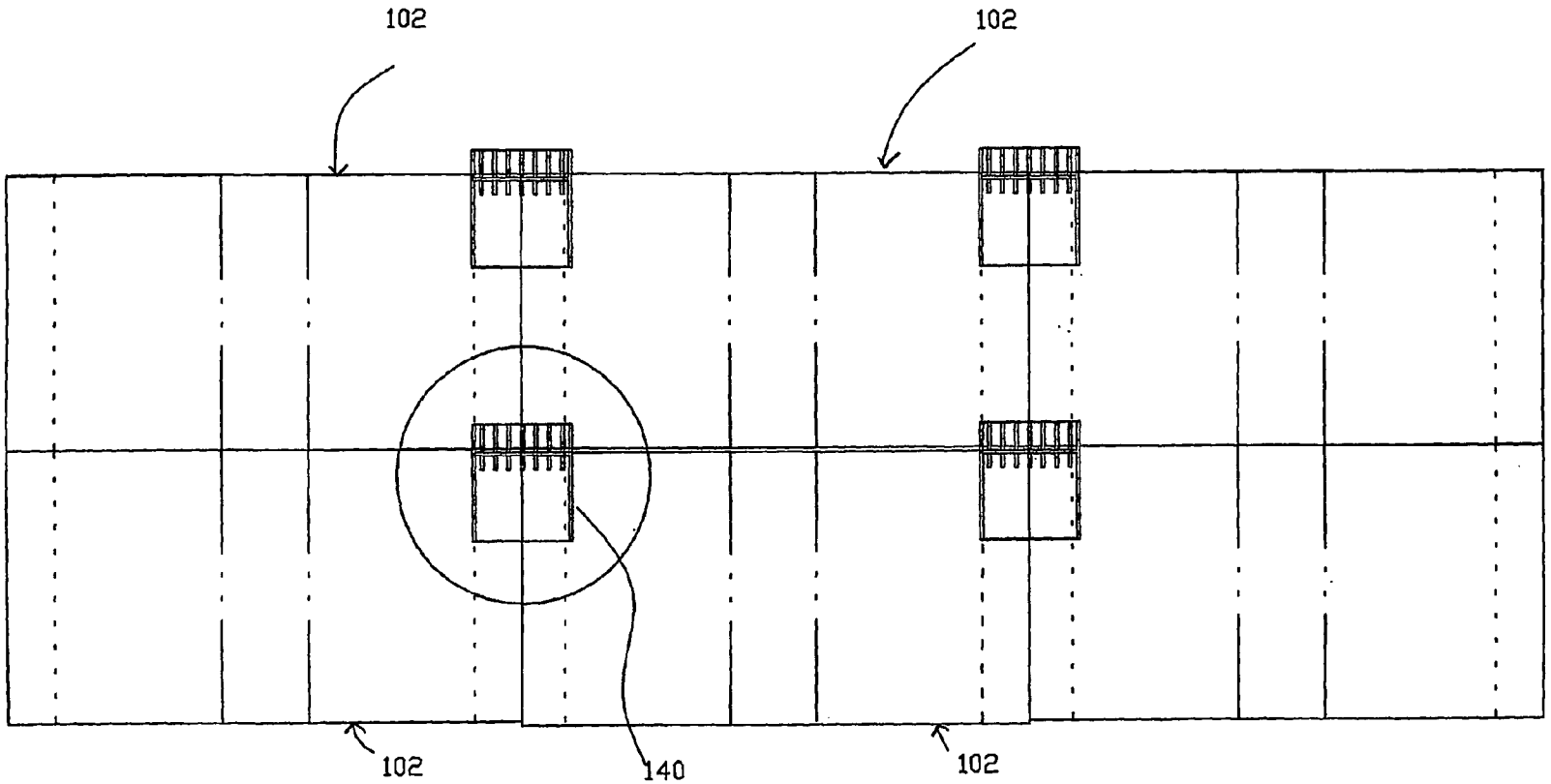
FIG. 20 is an X-ray view revealing the locations of the second location devices in courses of the second blocks.
Figure 21:
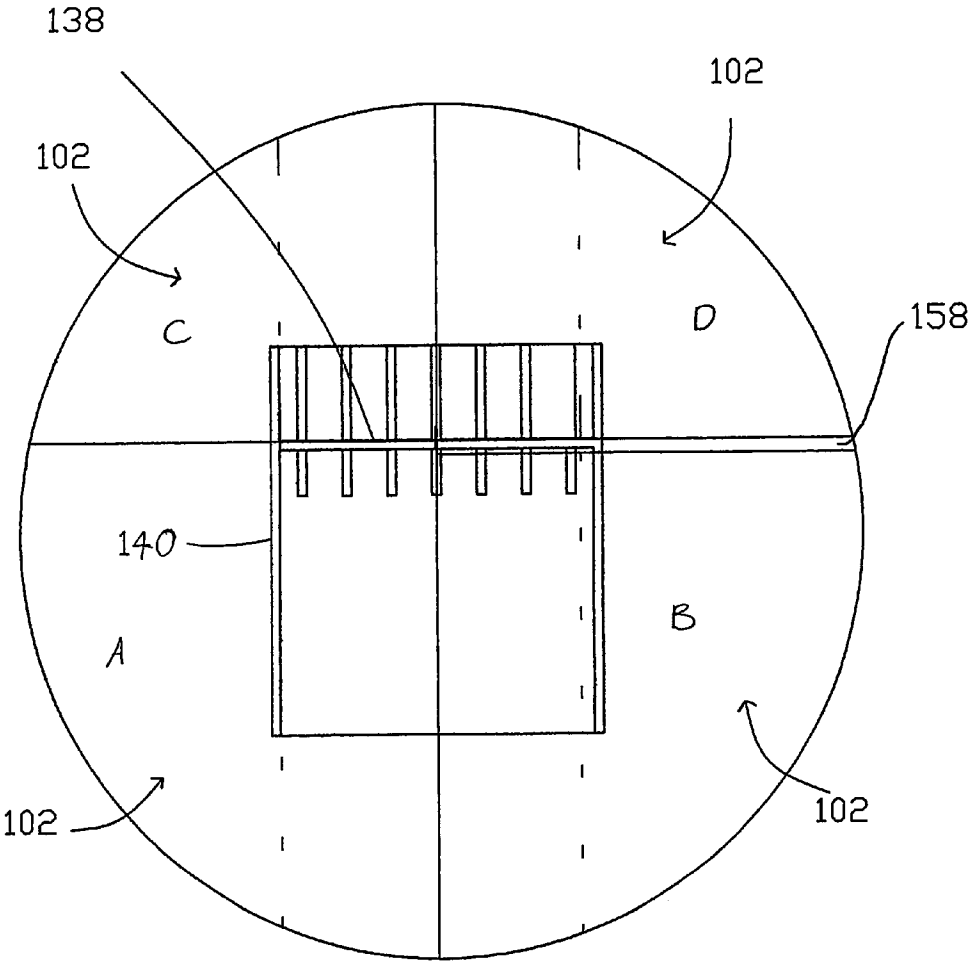
FIG. 21 is a detail of FIG. 20.

FIG. 20 illustrates another function of the location device 140 when placed between two courses of blocks 102 which are not each of uniform height. Non-uniform height of blocks is a common problem with dry stacked blocks. FIG. 21 shows details of the area inside the circle of FIG. 20. The blocks associated with the location device 140 are been labelled A, B, C and D. While block B is shorter than the correct height, the location device 140 compensates for this. The ledge 138 of the location device 140 is clamped on one side between blocks A and C by the top and bottom surface of their respective protrusions. This pressure supports the ledge 138 at the correct height on both sides despite block B's incorrect height. A gap 158 is created above block B, and block D is supported by the ledge 138 which is at the correct height ensuring that the wall maintains the correct level. Cementous paste will fill the gap 158 when the wall is complete.

Figure 22:
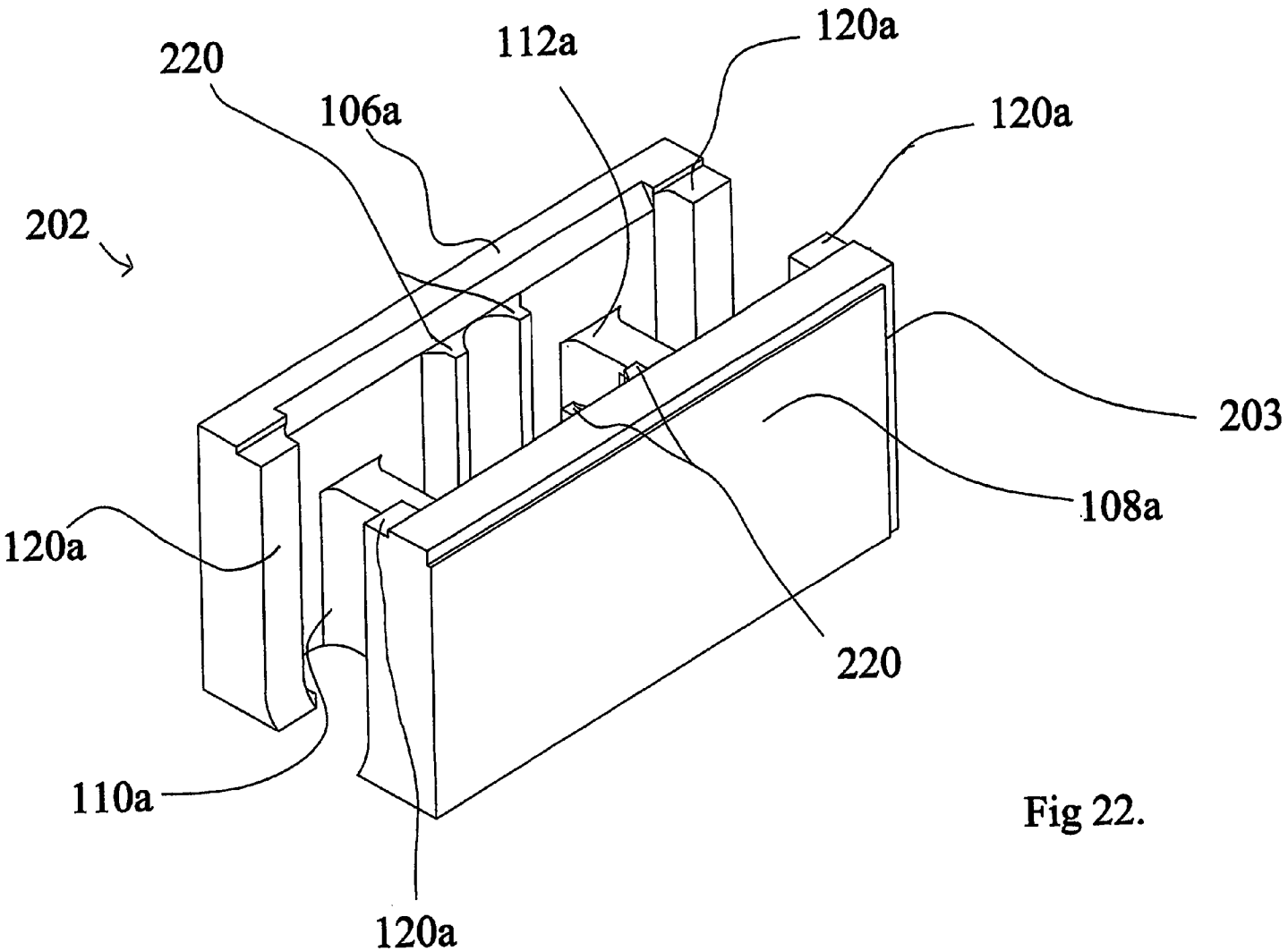
FIG. 22 is a perspective view of a third building block.
Figure 23:
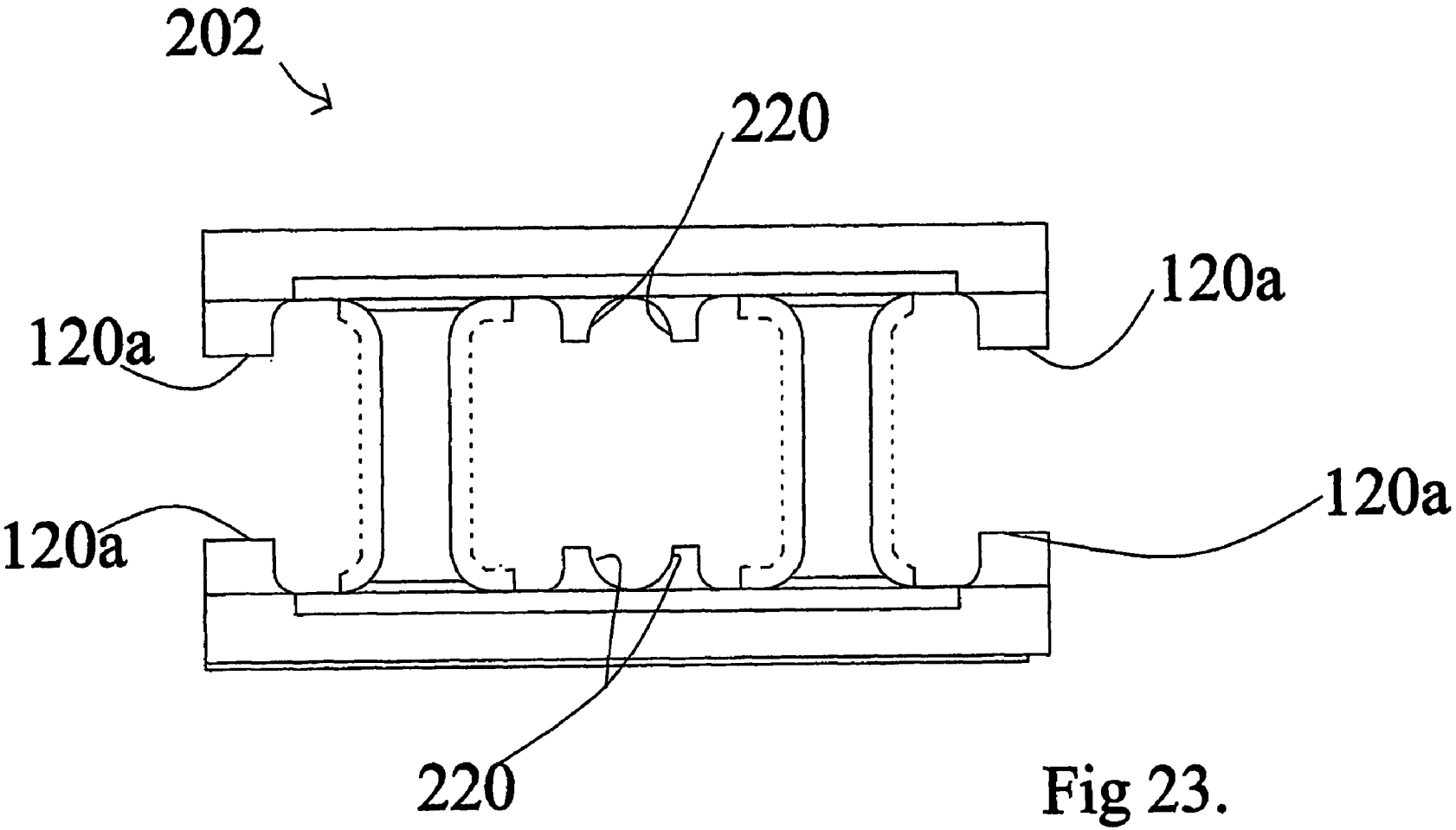
FIG. 23 is a plan view of the third building block.

Next is a description of a third example with reference to FIG. 22 through FIG. 32. FIG. 22 and FIG. 23 shows a third building block 202. The side panels 106*a* and 108*a*, bridging parts 112*a* and 110*a*, and protrusions 120*a* have a similar function to those of the second building block 102 of FIGS. 9 and 10 and for simplicity are referenced by the same reference numerals with subscript "a".

Additionally, block 202 has intermediate pairs of adjacent protrusions 220 on the inner sides of the side panels 106*a* and 108*a*. These allow the block 202 to hold a locative device, such as the locative device 140 of FIG. 14, at either the end or intermediate position of the block 202. Block 202 is designed for use in either stack or stagger pattern, and is provided with a lip 203 along at the top and side of one of the side panels 106*a* or 108*a* so to appear as a mortar line once laid.

Figure 24:
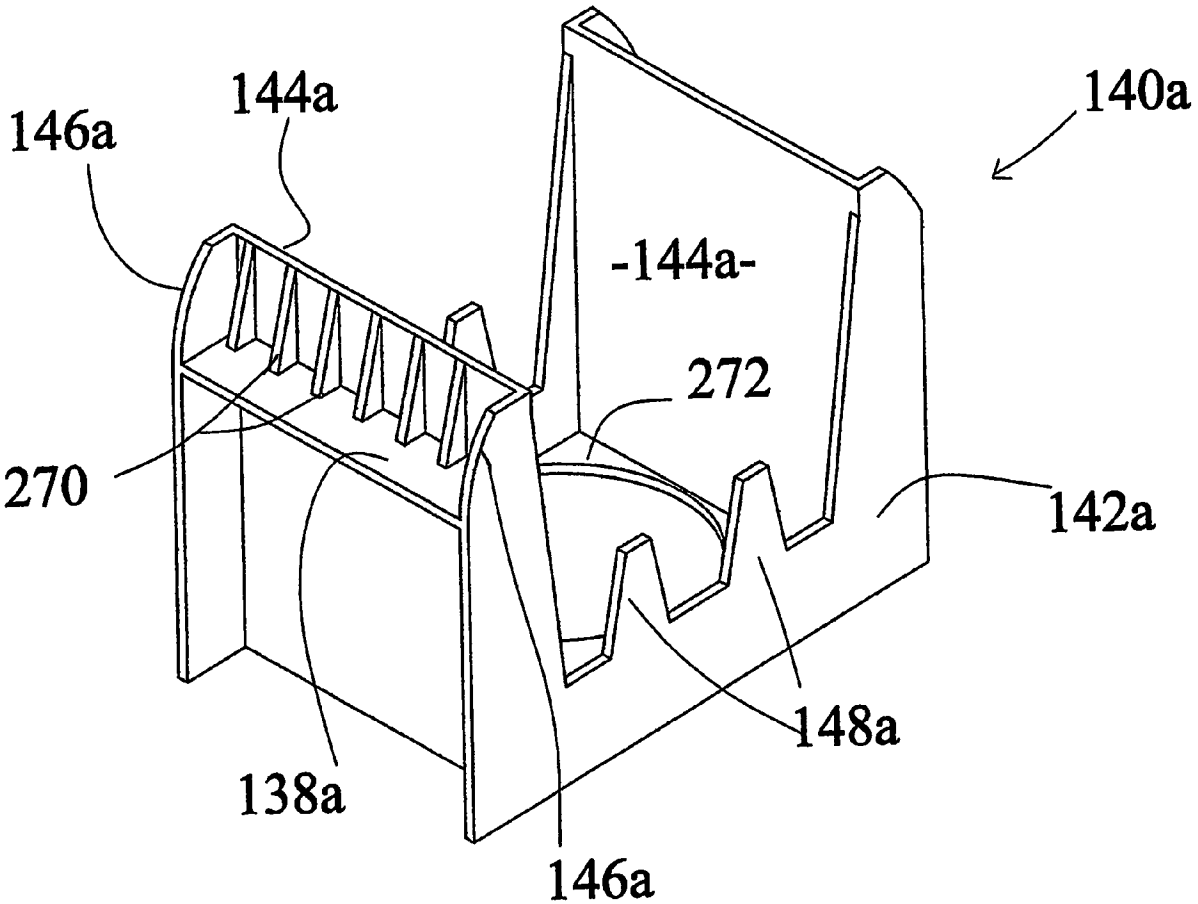
FIG. 24 is a perspective view of a third location device.

FIG. 24 shows a location device 140*a*. The members 142*a*, cross members 144*a*, ledge 138*a*, ends of the members 146*a* and projections 148*a* have a similar function to those of the location device 140 of FIG. 14 and for simplicity are referenced by the same reference numerals with subscript "a". The location device 140*a* further provides guide means in the form of ribs 270 for guiding the inner surface of protrusions 120*a* and 220 when placing in position a course of blocks on top of the location device 140*a*. Furthermore, the location device 140*a* includes a bottom member 272 with a circular aperture to provide a more rigid construction while still allowing concrete and vertical steel reinforcing rods to pass through.

Figure 25:
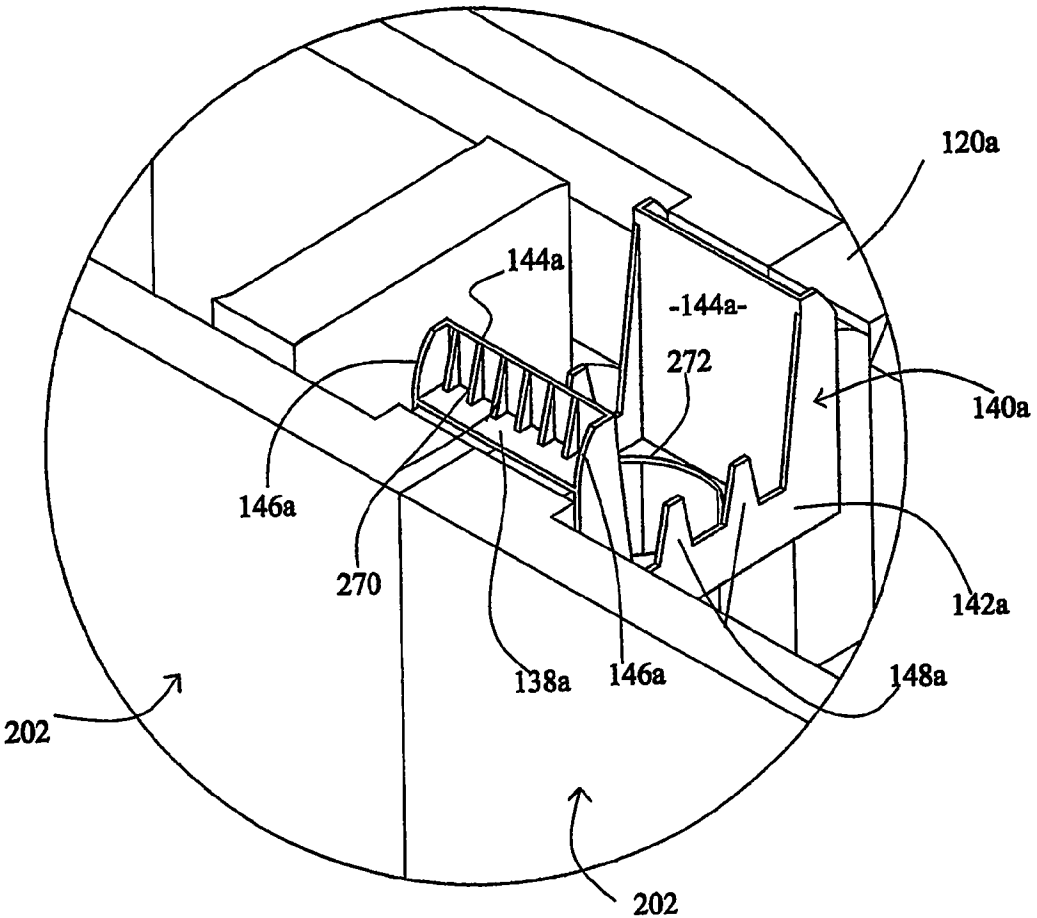
FIG. 25 is a perspective view of the third location device interconnecting two of the blocks shown in FIGS. 22 and 23.
Figure 26:
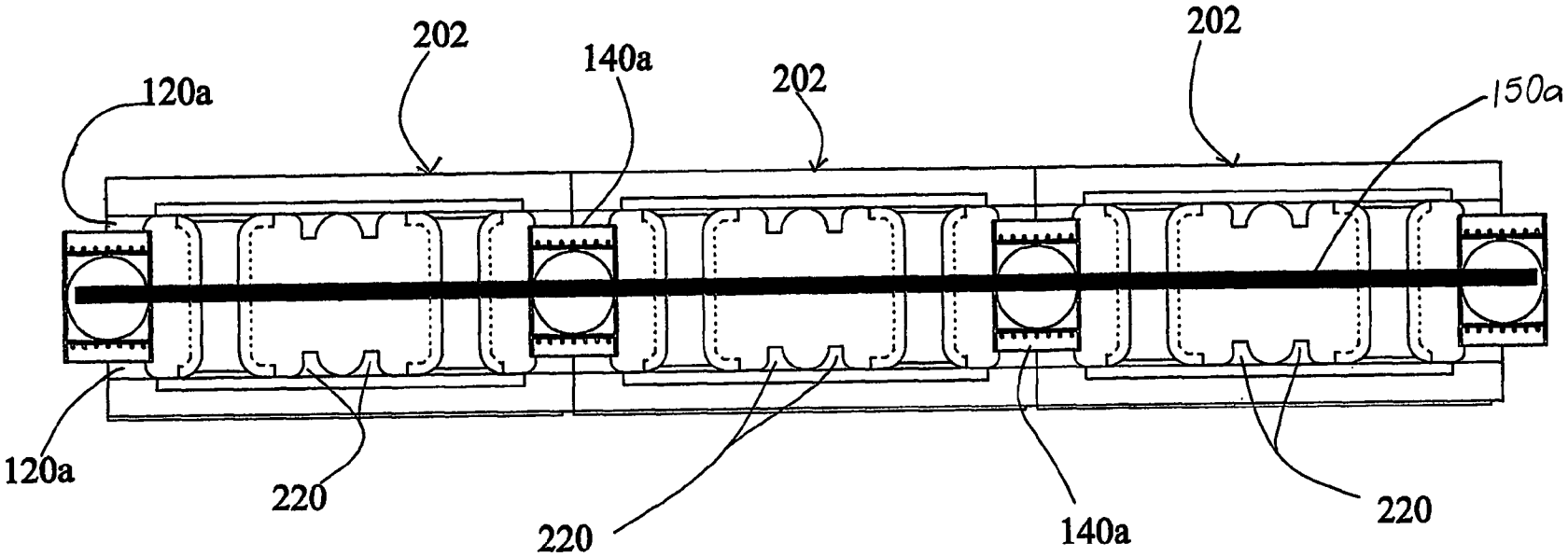
FIG. 26 is a plan view of part of a wall built using the third blocks and third location devices, and horizontally arranged reinforcing steel.
Figure 27:
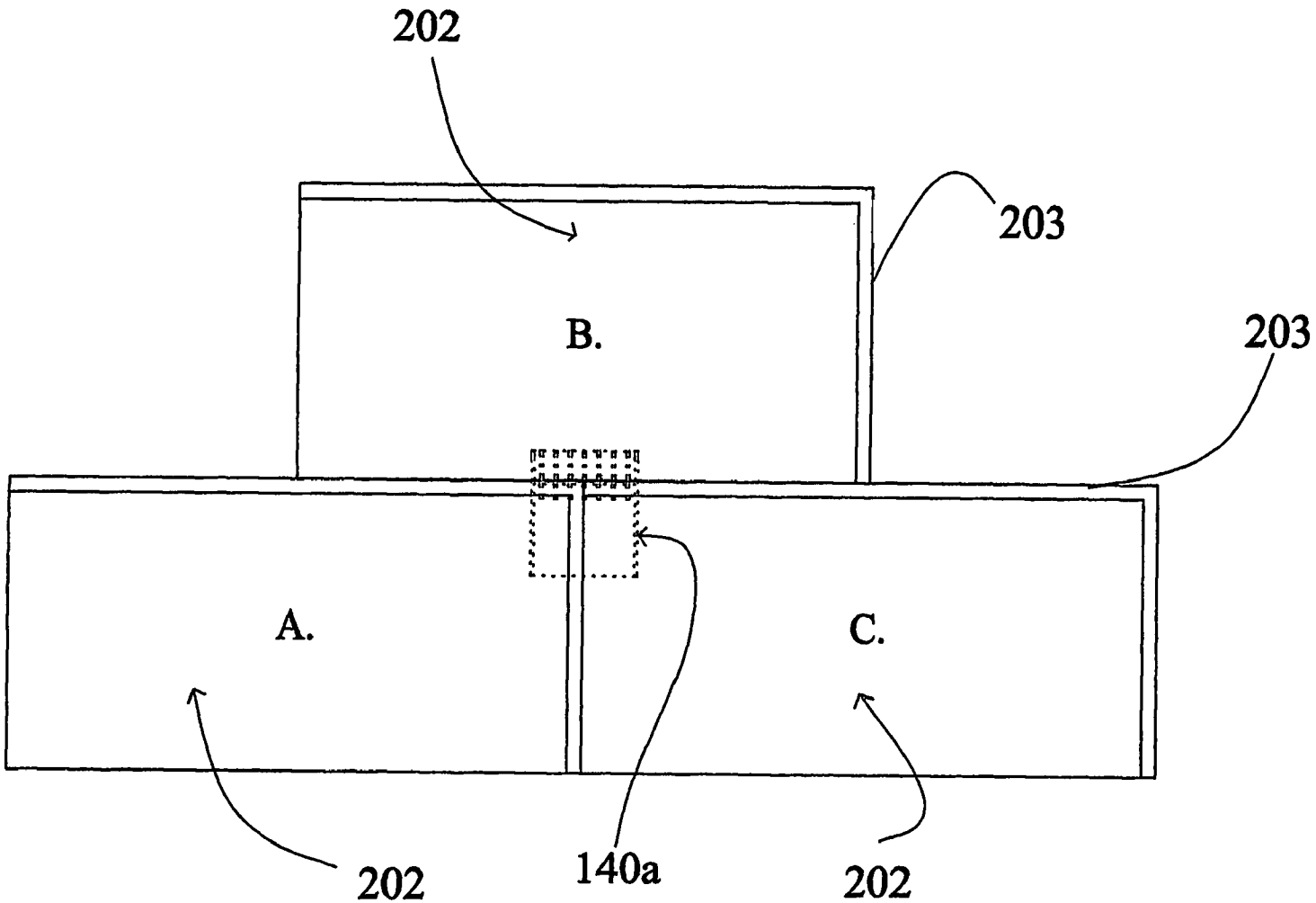
FIG. 27 is a side view of an x-rayed location device and three of the blocks of FIGS. 22 and 23 arranged as shown in FIG. 26 to form part of a wall.
Figure 28:
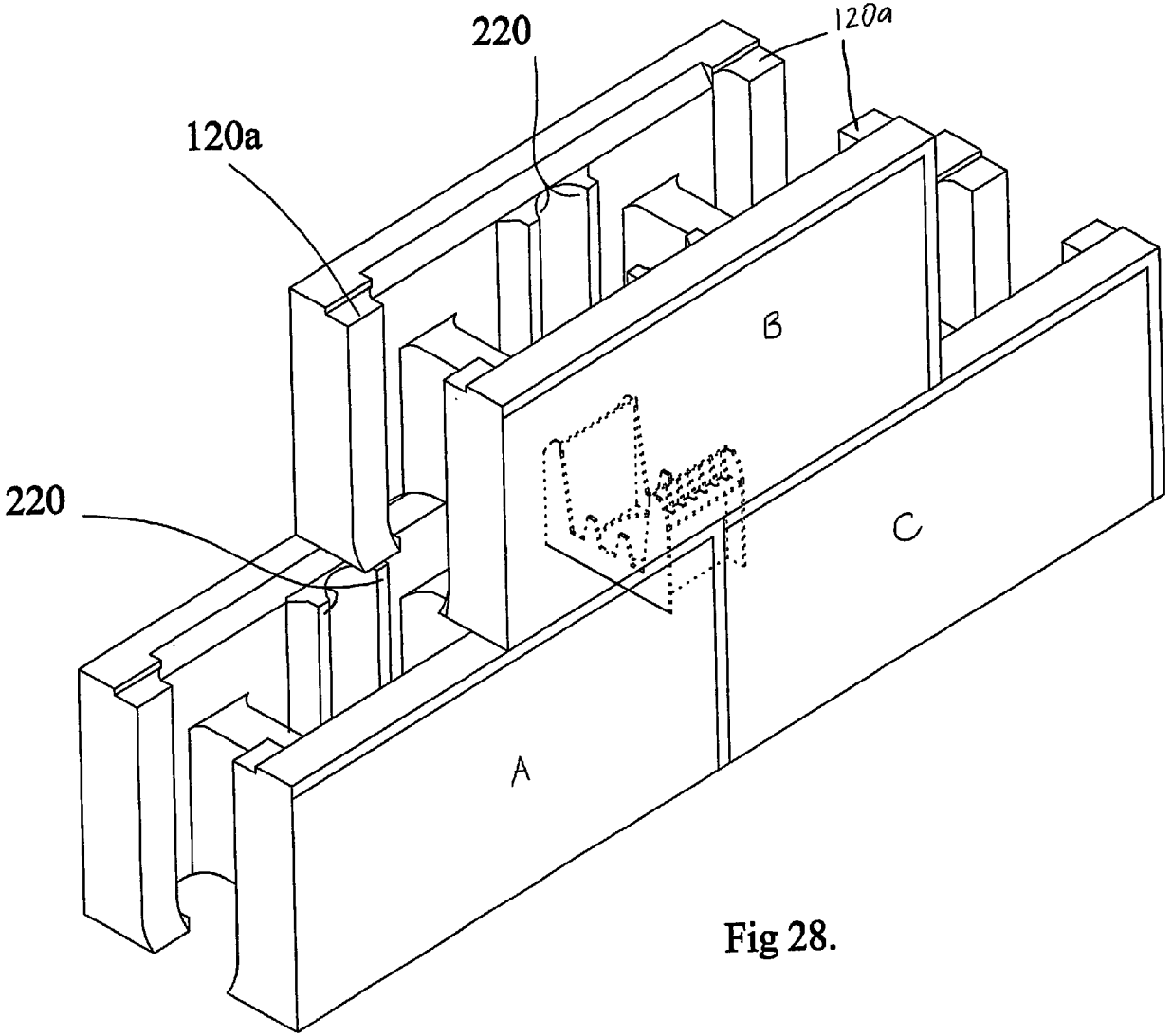
FIG. 28 is a perspective view of FIG. 27.

FIGS. 25 and 26 show a possible arrangement of the location devices 140*a* installed in a straight wall constructed by laying blocks 202 end to end. The location devices 140*a* are positioned between each building block 202 clamped onto a pair of opposing protrusions 220 from each building block 202. The location devices 140*a* support a reinforcement steel rod 150*a* which clicks into position bringing the blocks into alignment. As shown in FIG. 27 and FIG. 28, this arrangement of the location devices 140*a* enables a stagger bond pattern for the next course of blocks. Block B is staggered across A and C, with the location device 140*a* clamping the protrusions 220 of Block B. Here the lips 203 at the top and along one side appear as a mortar line. To lay a next course of blocks the location devices would be positioned on either side of block B, clamping on the protrusions 120*a* of block B and the protrusions 120*a* of adjacent blocks (not shown).

Figure 29:
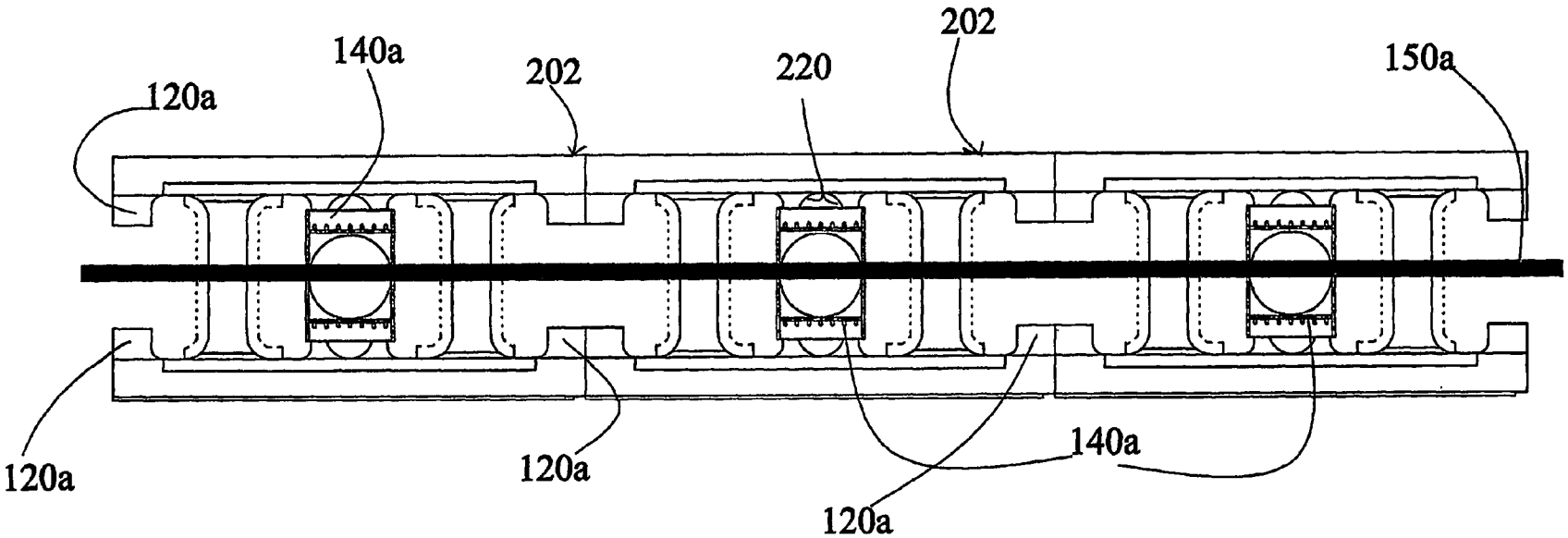
FIG. 29 is a plan view of a variation in the arrangement of the third location device as shown in FIG. 26.
Figure 30:
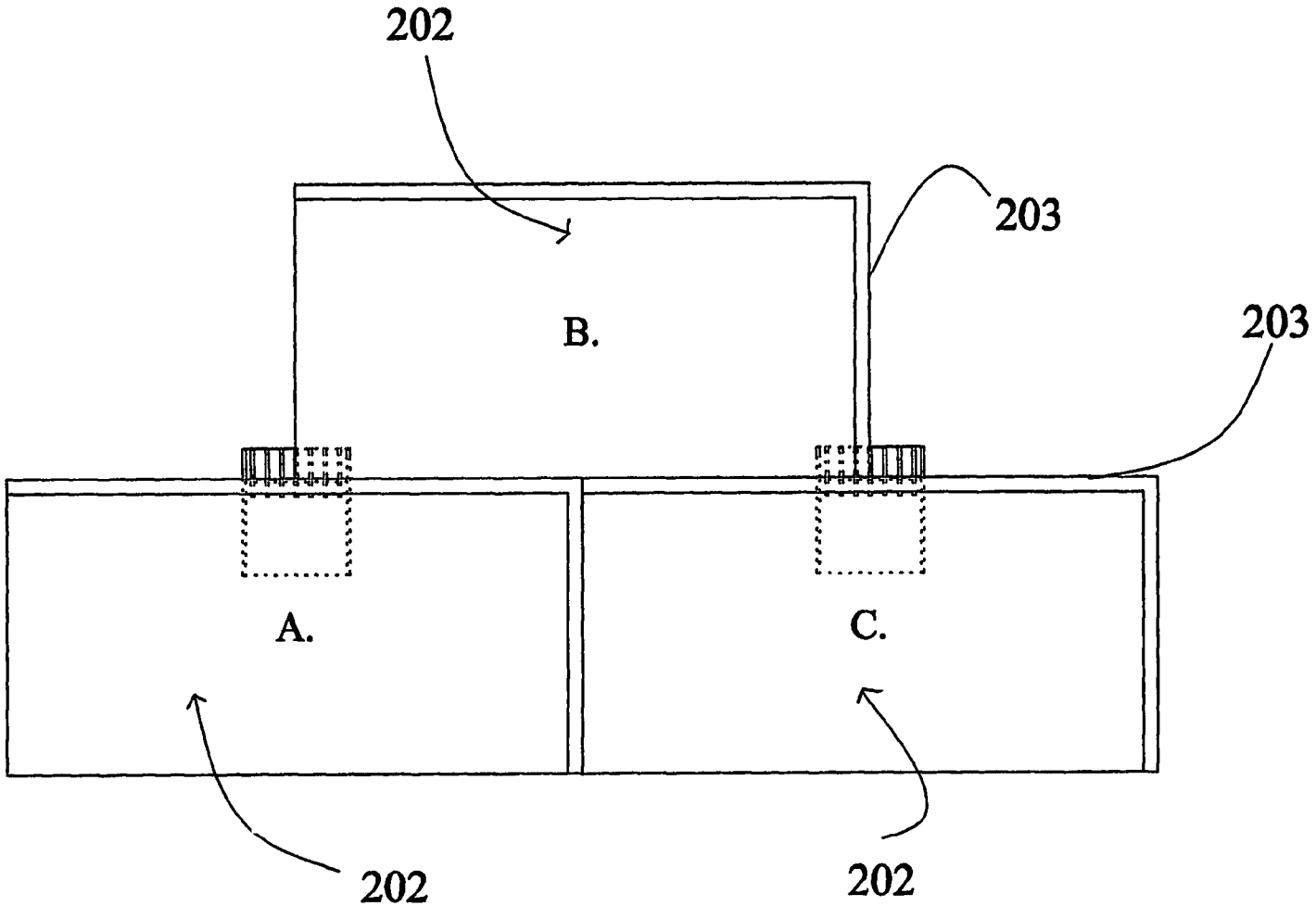
FIG. 30 is a side view of three blocks of FIGS. 22 and 23 showing an x-rayed location device arranged as shown in FIG. 29 to form part of a wall.
Figure 31:
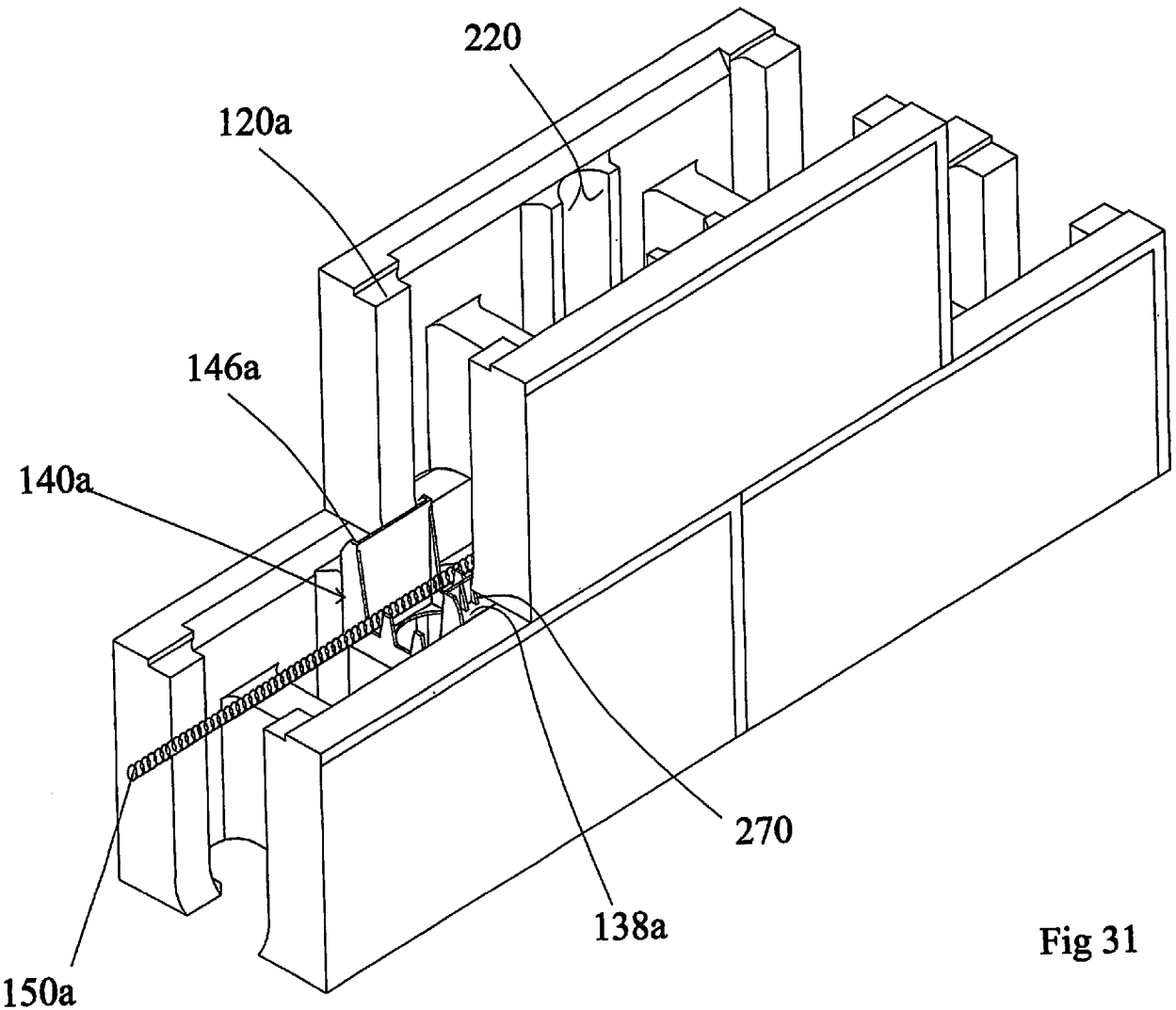
FIG. 31 is a perspective view of FIG. 30.

FIGS. 29, 30 and 31 show an alternate arrangement of the location devices 140*a* that also creates a stagger bond pattern. In FIG. 29 a first course of blocks is laid end to end with the location devices 140*a* fitted to the center of each block, clamping onto the protrusions 220. The installation of the steel reinforcement rod 150 helps to align the blocks correctly. As shown in FIGS. 30 and 31, a next course of blocks is laid by aligning the base side of the protrusions 120*a* of block B against the ledge 138*a*, and the side of the protrusions 120*a* with the ends of the members 146*a*. Ribs 270 guide the inner side of the protruding portions 120*a* when placing the block B in position. To lay the next course of blocks a location device would be positioned in the middle of block B, clamping on the protrusions 220.

Figure 32:
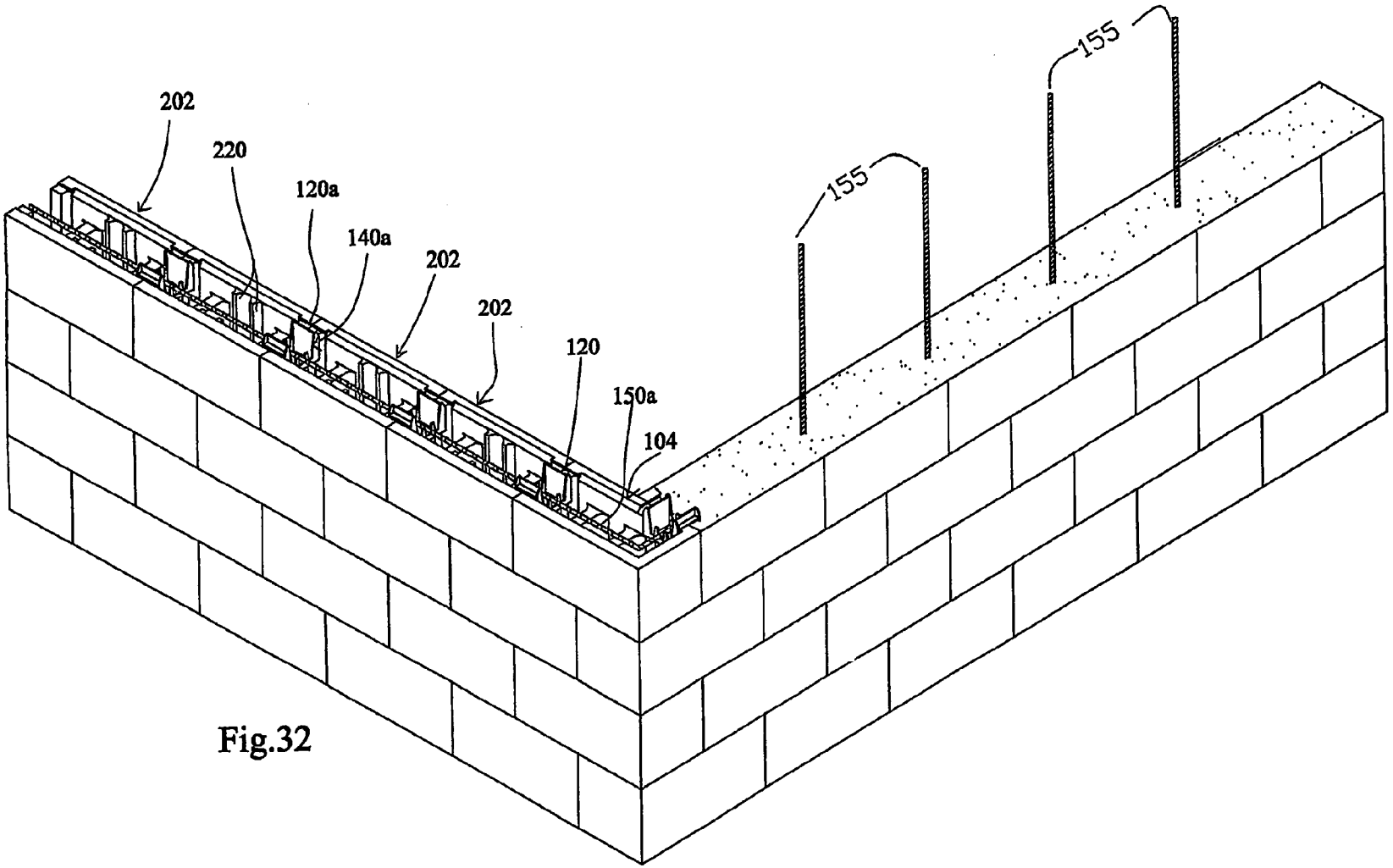
FIG. 32 is a perspective view showing more of the wall of FIG. 28 with vertical steel reinforcement.

FIG. 32 shows more of the wall of FIGS. 26 and 29. The locative devices 140*a* can be fitted to the protrusions 220 or 120*a* of blocks 202, protrusions 120 of block 104, or are not fitted at all, depending on requirements for accurate location of the reinforcing rod 150*a* and the area of the wall. Part of the wall has vertical steel reinforcement rods 155 installed, and filled with concrete paste.

Figure 33:
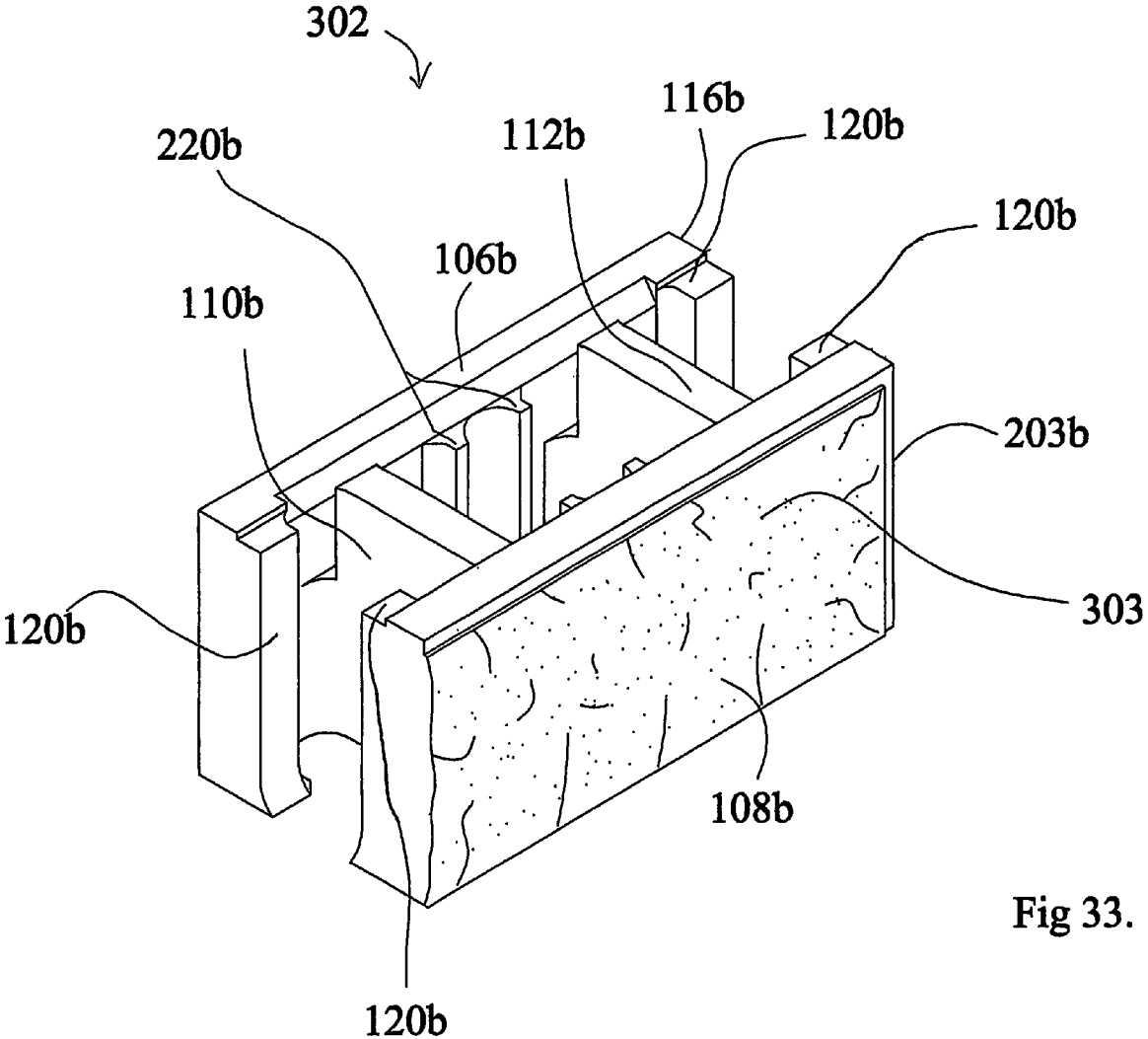
FIG. 33 is a perspective view of a modified third block.

FIG. 33 shows an alternative block 302. This blocks has similar features to the block 102 of FIGS. 9 and 10, and the block 202 of FIG. 22, and similar parts are denoted by the same reference numerals with a subscript "b". Additionally, block 302 provides a pattern on the outer face 303 of a side panel 118*b* to give the appearance of a traditional stone block wall once laid.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The claims defining the invention are as follows:

1. A block and locator combination comprising:

three blocks and a locator, each block having two spaced apart side walls with opposite ends defining opposite ends of the block and upper and lower edges defining at least in part an upper face and a lower face of the block respectively, and one or more connecting walls connecting one side wall to the other and defining at least two cavities, one opening to one end on one side of said one or more connecting walls and one opening to the other end on the other side of said one or more connecting walls, two spaced apart first protuberances extending from said side walls towards each other intermediate the ends of said side walls respectively and two pairs of spaced apart opposed second protuberances spaced from said respective first protuberances on opposite sides thereof, said locator engaging with one pair of said spaced apart second protuberances of each of two of said blocks when said two blocks are laid end to end so as to secure said two blocks together against movement at least in a direction from one side wall towards the other, said locator engaging with said spaced apart first protuberances of said third block so as to secure said third block to said two blocks laid end to end when laid thereon against movement at least in a direction from one side wall towards the other.

2. The combination according to claim 1, wherein said spaced apart second protuberances extend into said cavity or at least one of said cavities opening to one end.

3. The combination according to claim 1, wherein said spaced apart second protuberances have respective first contact faces facing each other.

4. The combination according to claim 3, wherein parts of said first contact faces are adjacent the ends of said side walls respectively.

5. The combination according to claim 1, wherein said spaced apart second protuberances have respective second contact faces substantially orthogonal to said first contact faces.

6. The combination according to claim 5, wherein said respective second contact faces are spaced from the ends of said side walls.

7. The combination according to claim 1, wherein said spaced apart first protuberances are midway along said side walls.

8. The combination according to claim 1, wherein said locator comprises two spaced apart outward facing first contact portions and two spaced apart outward facing second contact portions, engagement of said locator with said second protuberances of said two blocks laid end to end being by said second contact portions and engagement of said locator with said third block being by said outward facing first contact portions so as to secure said locator to said block against movement from one side wall towards the other.

9. The combination according to claim 8, wherein said locator further comprises third spaced apart contact portions engaging with said spaced apart second protuberances so as to secure said two blocks laid end to end together against relative movement in a direction from end to end, said third spaced apart contact portions engaging with said spaced apart first protuberances of said third block so as to secure said third block to said two blocks laid end to end against movement in a direction from one end of said side walls towards the other.

10. The combination according to claim 1, wherein said locator comprises spaced apart fourth contact portions in contact with said pairs of second protuberances of said two blocks laid end to end whereby at least a portion of said locator extends above said upper edge of said side walls of said two blocks laid end to end.

11. The combination according to claim 10, wherein said spaced apart second protuberances each have an upper edge and said fourth contact portions are engaged with said upper edges.

12. The combination according to claim 11, wherein said spaced apart second protuberances comprise walls or wall portions extending from one side wall towards the other and said fourth contact portions are engaged with upper edges of said walls or wall portions of said second protuberances.

13. The combination according to claim 12, wherein said one or more connecting walls of said block have upper edges and said upper edges are spaced substantially below the upper edges of said side walls.

14. The combination according to claim 11, wherein said locator further comprises a fifth portion adapted to support a reinforcing bar thereon spaced from said fourth contact portion and said fifth portion is arranged in use to align substantially with the upper edges of said connecting walls.

15. The combination according to claim 14, wherein said fifth portion has contact faces adapted to locate reinforcing bar in a predetermined position relative to said fourth contact portions.

16. A concrete building block comprising:

two spaced apart concrete side walls with opposite ends defining opposite ends of said block and upper and lower edges respectively defining at least in part an upper face and a lower face of said concrete building block;

two spaced apart connecting walls integrally formed and contiguous with said side walls and connecting one side wall to the other and holding said sidewalls in fixed relation to each other, said sidewalls and said connecting walls defining a first cavity therebetween on one side extending through the block and opposite end cavities on the other sides of said two connecting walls respectively, said end cavities respectively opening to the opposite ends of the block;

said side walls comprising spaced apart aligned first protuberances between said connecting walls, each first protuberance extending into said first cavity and having a first contact face facing the opposite side wall and two opposed spaced apart second contact faces facing opposite ends of said block; and two pairs of spaced apart opposed second protuberances between said connecting walls and said opposite ends of the block respectively and extending into said end cavities respectively wherein the connecting walls and the protuberances do not extend past the upper and lower edges of the side walls.

17. A block according to claim 16, wherein said second contact faces are substantially orthogonal to said first contact faces.

18. A block according to claim 16, wherein said first protuberances are midway along the length of said side walls.

19. A block according to claim 16, wherein said spaced apart second protuberances have respective first contact faces facing each other.

20. A block according to claim 19, wherein parts of said first contact faces of said spaced apart second protuberances are adjacent the ends of said side walls respectively.

21. A block according to claim 19, wherein said spaced apart second protuberances have respective second contact faces facing the opposite ends of said block.

22. A block according to claim 21, wherein said respective second contact faces are orthogonal to said first contact faces.

23. A locator comprising:

opposed first contact portions facing away from each other and defining a first space therebetween;

opposed second contact portions adjoining said first contact portions respectively and facing in the same direction as the first contact portions and defining a second space therebetween, said second space being contiguous with said first space;

at least one connecting portion extending across said first space and connecting said first contact portions;

said first space and said second space forming a passage defined by said first contact portions, said second contact portions, and said at least one connecting portion, said passage opening at opposite ends at least between said first contact portions and being adapted to receive reinforcing bar therethrough; and two pairs of opposed third contact portions adjoining said first contact portions respectively and extending outwards therefrom, each pair of said third contact portions facing towards each other in a direction lateral to the direction faced by said respective first contact portions and defining a third space therebetween.

24. A locator according to claim 23, wherein said connecting portion is adapted to support reinforcing bar thereon.

25. A locator according to claim 24, wherein said connecting portion further comprises two spaced apart protrusions formed as webs and each web has a plurality of recesses adapted to locate therein reinforcing bar supported on said webs.

26. A locator according to claim 23, wherein said connecting portion is constructed of a flexible and resilient material which allows said spaced apart first contact portions to be selectively moved towards each other so as to narrow at least a portion of said passage.

27. A locator according to claim 23, wherein said first contact portions each have two ends and said connecting portion adjoins each of said first contact portions adjacent one of said ends.

28. A locator according to claim 27, wherein said second contact portions extend from the other ends of said first contact portions respectively and are integral therewith.

29. A locator according to claim 23, further comprising stop portions adjoining said first contact portions respectively and extending outwards therefrom away from said passage.

30. A locator according to claim 29, wherein each stop portion comprises a fourth contact portion facing in a direction orthogonal to the directions faced by said first, second and third contact portions.

31. A locator according to claim 29, wherein said first contact portions comprise a plurality of outward facing spaced apart ribs adjacent said stop portions.

32. A wall comprising:

a row of concrete building blocks laid end to end, each block having two spaced apart side walls of substantially the same height and one or more connecting walls integrally formed and contiguous with said side walls and connecting one side wall to the other and holding said side walls in fixed relation to each other, said side walls and said one or more connecting walls defining a cavity on at least one side of said one or more connecting walls, at least a portion of all of said one or more connecting walls being substantially lower in height than said side walls;

a straight reinforcing bar extending along said row of blocks on or above said connecting walls and between said spaced apart side walls; and a plurality of locators according to claim 23 engaged with said reinforcing bar at predetermined positions along the length of said reinforcing bar so as to substantially prevent side to side movement relative thereto, said locators also being operatively engaged with said spaced apart side walls of selected ones of said blocks adjacent said predetermined positions so as to hold said blocks in a predetermined position relative to said reinforcing bar, at least some of said locators being engaged with adjacent blocks so as to secure them together against movement at least in a direction from one side towards the other.

33. A wall comprising:

a row of concrete building blocks laid end to end, each block having two spaced apart side walls of substantially the same height and one or more connecting walls integrally formed and contiguous with said side walls and connecting one side wall to the other and holding said side walls in fixed relation to each other, said side walls and said one or more connecting walls defining a cavity on at least one side of said one or more connecting walls, at least a portion of all of said one or more connecting walls being substantially lower in height than said side walls;

a plurality of locators according to claim 23 operatively engaged with the spaced apart side walls of selected ones of said blocks, at least some of said locators being engaged with adjacent blocks so as to secure them together against movement at least in a direction from one side towards the other; and a reinforcing bar extending along said row of blocks on or above said connecting walls and between said side walls, said reinforcing bar being held in a predetermined position relative to said spaced apart side walls of said selected blocks by said plurality of locators.

34. A method of constructing a wall comprising:

providing a plurality of blocks, each block having two spaced apart side walls with opposite ends defining opposite ends of said block and one or more connecting walls connecting one side wall to the other and defining a cavity on at least one side thereof, first spaced apart protuberances intermediate the ends of said side walls and second spaced apart protuberances spaced from said first spaced apart protuberances;

providing a plurality of locators, each locator having opposed connected first contact portions facing away from each other and defining a first space therebetween and opposed second contact portions adjoining said first contact portions respectively and facing in the same direction as the first contact portions and defining a second space therebetween, said second space being contiguous with said first space, and two pairs of opposed third contact portions adjoining said first contact portions respectively and extending outwards therefrom, each pair of said third contact portions facing towards each other in a direction lateral to the direction faced by said first contact portions and defining a third space therebetween;

laying a first row of said blocks end to end;

fitting a locator to each two adjacent blocks such that the first contact portions engages the second protuberances of the adjacent blocks to secure them together against movement from side to side; and laying a second row of blocks on top of said first row such that the first protuberances of each block in the second row engages with the second contact portions of a locator fitted to two adjacent blocks in the first row of blocks so as to secure the blocks in the second row to the first row against relative movement from side to side relative thereto.

35. A method according to claim 34, wherein said locators are fitted to each two adjacent blocks such that said third contact portions engage with said second protuberances of the two adjacent blocks so as to secure the blocks against relative movement from end to end.

36. A method according to claim 35, wherein each of said second protuberances has an upper edge and each of said locators has at least one stop portion and said locators are fitted to each two adjacent blocks such that said stop portion engages said upper edge of said second protuberances of the two adjacent blocks so as to limit engagement of said locators with the blocks in the first row.

37. A method according to claim 36, wherein each of said locators have fourth contact portions and said second row of blocks are laid such that said first spaced apart protuberances engage said fourth contact portions to secure the blocks in the second row against movement from one end towards the other.

38. A method according to claim 34 further comprising filling the rows of blocks with concrete.

39. A method of constructing a wall comprising:

providing a plurality of blocks having two spaced apart side walls and one or more connecting walls connecting one side wall to the other and defining a cavity on at least one side of said one or more connecting walls, first spaced apart protuberances intermediate the ends of said side walls and second spaced apart protuberances spaced from said first protuberances;

providing a plurality of locators, each locator having opposed spaced apart first contact portions facing away from each other, opposed spaced apart second contact portions adjoining said first contact portions respectively and facing in the same direction as the first contact portions, and a pair of opposed spaced apart third contact portions adjoining each of said first contact portions and extending outwards therefrom, each pair of said third contact portions facing towards each other in a direction lateral to the direction faced by said respective first and second contact portions;

laying a first row of said blocks end to end;

fitting a locator to each two adjacent blocks such that the opposed spaced apart first contact portions of the locator engages the second protuberances of the adjacent blocks to secure them together against movement from side to side and such that the third contact portions engage the second protuberances of the adjacent blocks to secure them against movement from end to end; and laying a second row of blocks on top of said first row such that the first protuberances of each block engages the second contact portions of a locator fitted to two adjacent blocks in the first row of blocks.

40. A block and locator combination, comprising:

a concrete block and a locator, said block having two spaced apart side walls with opposite ends defining opposite ends of said block and upper and lower edges defining at least in part an upper face and a lower face of said block respectively, and one or more connecting walls integrally formed and contiguous with said side walls and connecting one side wall to the other and holding said side walls in fixed relation to each other, said side walls and said one or more connecting walls defining a cavity opening to one end at least on one side of said one or more connecting walls, two spaced apart opposed first protuberances intermediate the ends of said side walls respectively, said first protuberances having a first predetermined width in the direction of the length of the block and two spaced apart opposed second protuberances spaced from said first protuberances, said second protuberances having a second predetermined width in the direction of the length of the block, said first protuberances being adapted to be engaged by said locator in one instance and said second protuberance being adapted to be engaged by said locator in another instance, said locator engaging with said first protuberances in the one instance so as to secure said locator to said block against movement at least in a direction from one side wall towards the other, said locator having two pairs of spaced apart contact portions, one of each of said pairs engaging said second protuberances of said block and the other one of each pair being spaced therefrom by twice said second predetermined width so that said locator may secure two like blocks together end to end with the pairs of spaced apart contact portions engaging corresponding faces of the second protuberances of the two like blocks.

* * * * *